US012127610B2

(12) United States Patent
Ramirez et al.

(10) Patent No.: US 12,127,610 B2
(45) Date of Patent: Oct. 29, 2024

(54) FACE COVERING

(71) Applicants: John Ramirez, Redlands, CA (US); Emma Uribe, Redlands, CA (US); Marissa Uribe, Redlands, CA (US)

(72) Inventors: John Ramirez, Redlands, CA (US); Emma Uribe, Redlands, CA (US); Marissa Uribe, Redlands, CA (US)

( * ) Notice: Subject to any disclaimer, the term of this patent is extended or adjusted under 35 U.S.C. 154(b) by 431 days.

(21) Appl. No.: 17/489,669

(22) Filed: Sep. 29, 2021

(65) Prior Publication Data

US 2022/0256951 A1 Aug. 18, 2022

Related U.S. Application Data

(60) Provisional application No. 63/150,647, filed on Feb. 18, 2021.

(51) Int. Cl.
*A41D 13/11* (2006.01)

(52) U.S. Cl.
CPC ..... *A41D 13/1169* (2013.01); *A41D 13/1192* (2013.01)

(58) Field of Classification Search
CPC ..... A62B 23/00; A62B 23/02; A62B 23/025; A41D 13/11; A41D 13/1107; A41D 13/1115; A41D 13/1123; A41D 13/113; A41D 13/1138; A41D 13/1146; A41D 13/1153; A41D 13/1161; A41D 13/1169; A41D 13/1176; A41D 13/1184; A41D 13/1192
See application file for complete search history.

(56) References Cited

U.S. PATENT DOCUMENTS

| | | | | |
|---|---|---|---|---|
| 2,494,406 | A * | 1/1950 | Reitano | A41D 13/1161 128/206.13 |
| 5,467,765 | A * | 11/1995 | Maturaporn | A62B 23/025 128/206.13 |
| 6,338,340 | B1 * | 1/2002 | Finch | A62B 23/025 128/206.28 |
| 2004/0163649 | A1 * | 8/2004 | Shao | A41D 13/1192 128/205.27 |
| 2008/0110469 | A1 * | 5/2008 | Weinberg | A41D 13/1176 128/206.25 |
| 2009/0255542 | A1 * | 10/2009 | Ugai | A41D 13/1161 128/863 |
| 2010/0154805 | A1 | 6/2010 | Duffy et al. | |

(Continued)

FOREIGN PATENT DOCUMENTS

| | | |
|---|---|---|
| JP | 4767248 B2 | 9/2011 |
| JP | 2012080903 A | 4/2012 |

(Continued)

OTHER PUBLICATIONS

Cascade Healthcare Solutions. Anti-Fog Surgical Face Masks with Adhesive Tape by Medline. Retrieved from website on Oct. 25, 2022. https://www.cascadehealthcaresolutions.com/anti-fog-surgical-face-masks-with-adhesive-tape-p/non27371az.htm.

*Primary Examiner* — Colin W Stuart
(74) *Attorney, Agent, or Firm* — Wilson Sonsini Goodrich & Rosati

(57) ABSTRACT

Disclosed herein is a mask with an odor management mechanism comprising one or more channels, one or more edges with a skin adhesive, or anti-microbial material. Also disclosed herein is a mask with a liner infused with one or more skin.

19 Claims, 19 Drawing Sheets

(56) References Cited

U.S. PATENT DOCUMENTS

| | | | | |
|---|---|---|---|---|
| 2015/0034092 | A1* | 2/2015 | Michalak | B65D 27/00 128/848 |
| 2017/0281993 | A1* | 10/2017 | O | B01D 53/82 |
| 2019/0069611 | A1* | 3/2019 | Potnis | A41D 13/0053 |
| 2020/0268071 | A1* | 8/2020 | Newcomb | A62B 18/025 |
| 2021/0298384 | A1* | 9/2021 | Michalak | A41D 13/1115 |
| 2022/0053852 | A1* | 2/2022 | Baek | A41D 31/10 |

FOREIGN PATENT DOCUMENTS

| | | | |
|---|---|---|---|
| JP | 2014057864 | A | 4/2014 |
| KR | 20110112349 | A | 10/2011 |
| RU | 2415687 | C1 | 4/2011 |

* cited by examiner

FACE COVERING

CROSS-REFERENCE

This application claims priority to U.S. provisional application 63/150,647, filed on Feb. 18, 2021, the entirety of which is hereby incorporated by reference herein.

BACKGROUND OF THE INVENTION

Current face masks are not designed for extended use. For example, a student may be in school for about 6 hours, five days a week, wearing a face mask. Throughout that day the face mask will often reside on and rub a user's cheeks, which in turn, can irritate and dry the cheek area. Long term or even moderate but continual face mask usage can cause a disruption of the skin barrier (e.g., skin irritation or drying). Long term use of face masks, for example during a school day, may also cause chaffing and dryness particularly around the wearer's cheeks.

During extended use of a face mask, moisture can build up around the nose and mouth after only moderate use or after moderate amounts of talking while wearing a conventional face mask. For example, talking can release droplets of saliva. If one is wearing a face mask most of these saliva droplets are caught by the mask and land on the interior surface of the face mask, primarily along the face mask middle portion closest to and around the wearer's mouth and nose. A noticeable odor can be created which is the result of moisture buildup primarily from the accumulated saliva droplets on the face mask. Odor creation emanating from the interior surface of the face mask can be an indication of bacteria buildup on the face mask and can therefore have harmful effects for the user.

Current reusable cloth and disposable surgical masks are designed for minimal or no talking while wearing a mask. Current face masks are not designed to expand with a jaw of a user. For example, current face masks with static left and right edges are pulled downward by jaw movement. As a result, the wearer has to often grab the face mask and readjust it when speaking. Over a prolonged period of time, the more the wearer speaks the more the entire face mask is moved downward, causing the wearer to manually pull the face mask back up with his or her hand. This process of face mask creep and manual readjustment continues the more the wearer speaks.

Additionally, current face masks, which are designed to meet the needs in a medical setting, are touched by ungloved hands to reposition the face mask back to its original position before speaking. Such touching may transfer a contaminant onto the exterior surface of the face mask, thereby placing the user at potential risk for exposure to any contaminants on the individual's hands.

The present invention provides a unique and substantially improved face mask that addresses these problems such as the substantial prevention of air escaping through from the top edge of the face mask. In some embodiments described herein, air can be prevented from escaping using an adhesive and a moisture reduction system. In some embodiments, an adhesive and a moisture reduction system can prevent a user's eyewear from fogging and/or to prevent the build up of moisture between the face mask and the wearer's mouth area. The present invention also provides a face mask having an interior surface comprising skin care agents to protect a wearer's skin. The present invention can also provide a face mask having a dynamic left and right edge that automatically expands and retracts with movement of the jaw of a user, thereby minimizing the need for manual face mask readjustments by the wearer while speaking.

SUMMARY OF THE INVENTION

Disclosed herein is a face covering for filtering air comprising an inner layer, an outer layer, and a middle layer, wherein the inner layer comprises a skin care agent. The face covering can be configured to cover a portion of a user's face from below the eyes of a user and extend to under a chin of the user. The middle layer can comprise a hydrophilic material for superior moisture absorbency. The face covering can further comprise a plurality elongated depressions. The plurality of elongated depressions can comprise a hydrophobic material for superior moisture transfer. The inner layer can comprise an adhesive. The adhesive can comprise an acrylate. The adhesive can be along a top edge of the face covering. The adhesive can be a discontinuous line of adhesive. The adhesive is one that adheres to the skin of the wearer without causing injury to the wearer's skin. The adhesive can cover 25% of a length of the top edge of the face covering. The inner layer can also comprise a skin care agent that can comprise a moisturizer. The moisturizer can include a humectant or one or more of aloe vera, honey, hydroxyl acid, Vitamin A, zinc, hyaluronic acid, glycerin, or ceramide. The skin care agent can be positioned the face covering left portion and right portion to cover and protect the skin of the wearer's cheek from decay due to dryness or chaffing. The inner layer can also comprise an anti-inflammatory that can comprise one or more of salicylic acid, licorice extract, green tea, turmeric, *Centella asiatica*, colloidal oatmeal, chamomile, or resveratrol. The middle layer or the exterior layer can comprise an anti-microbial agent. The anti-microbial agent can comprise one or more of copper, silver, an organosilane coating, a bactericide, a viral inhibitor, or a fungal inhibitor. The bactericide can comprise one or more of gentamicin, cephalothin, carbenicillin, amoxicillin, cefamandole, tobramycin, vancomycin, or chlorohexidine. The viral inhibitor can be N,N dodecyl, methylpolyethylenimine or a derivative thereof. The fungal inhibitor can be a chromogranin A-derived antifungal peptide or a derivative thereof. The middle layer can comprise an electrostatically charged material. The face mask can further comprise a formable element configured to form around a nose of a user. The formable element can be metal, foam, or plastic. The outer layer, also known as the exterior layer, can comprise a polypropylene based material or a cloth based material. The face covering can comprise a sterile liner that is removed prior to application. The face covering can comprise an expandable element. The expandable element can extend from a top portion of the face covering to a bottom portion of the face covering. The expandable element can extend vertically from a top portion of the face covering to a bottom portion of the face covering.

Disclosed herein is also a system for odor control in a face covering, comprising a face covering configured to cover a nose and a mouth of a student, such as a face covering comprising moisture redirection sections comprising channels configured to dissipate air or moisture from a center of the face covering to a periphery of the face covering. These moisture redirection channels can be hydrophobic. Odor may further be minimized by providing moisture absorbent sections which are hydrophilic. The moisture absorbent sections can comprise a sponge material. The system can further comprise a skin care agent along a side portion, and a top portion of the face covering in contact with skin of the student. The system can further comprise a skin contact adhesive that is coupled with a skin care agent along the interior surface of a top portion of the face covering. The face covering can comprise a plurality of layers, including an inner layer, an outer layer, and a middle layer disposed between the inner layer and the outer layer, wherein the moisture absorbent sections are disposed in the middle layer of the face covering.

The face mask can comprise a dynamic left edge and right edge enabling the face mask left edge and right edge to expand and contract in a manner that mimics the downward and upward movements of the student's mouth or jaw when the student verbally communicates while wearing the face mask. The face mask dynamic left edge and right edge is able to expand and automatically retract by the unique placement of elastomers strategically positioned and permanently affixed along the face mask left edge and right edge.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
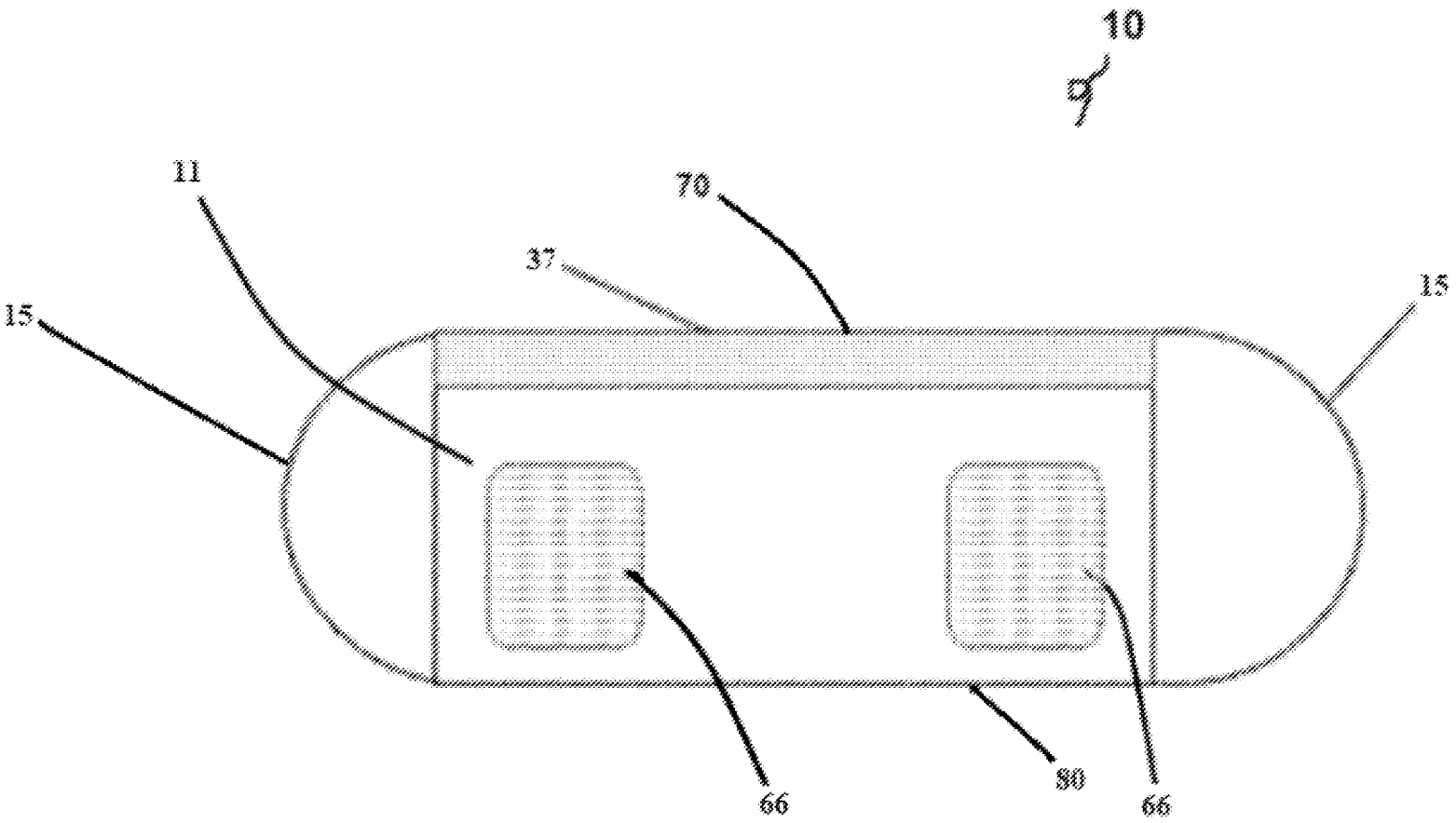
FIG. 1 illustrates an interior surface of a face mask.

Disclosed herein is a face mask that can substantially prevent air from escaping from a top edge of a face mask using an adhesive. The face mask can comprise a moisture reduction system to prevent a user's eyewear from fogging and to prevent the build up of moisture. Also disclosed herein is a face mask having an interior surface comprising skin care agents to protect a user's skin.

The Skin Contact Adhesive

Disclosed herein is a face mask wherein an interior layer of the face mask comprises a skin contact adhesive. The skin contact adhesive layer can comprise an adhesive surface for application on a skin of the user. The skin contact adhesive can be configured to be temporarily adhered to the skin of the user.

The skin contact adhesive can be positioned along the top edge of the mask, preferably along the entire top edge of the interior surface. The skin contact adhesive can be applied in discontinuous segments along at least one edge in order to allow enough airflow for a user to breathe comfortably. The skin contact adhesive may be applied discontinuously along a top edge, a left edge, or a right edge. The skin contact adhesive can be applied continuously along a top edge, a left edge and a right edge. The skin contact adhesive may be applied continuously along a top edge, a left edge and a top edge. The skin contact adhesive may be applied continuously along a top edge, a right edge, and a top edge. The skin contact adhesive may be applied continuously along a top edge and discontinuously alone one or more of a right edge, and a left edge.

In some aspects, the skin contact adhesive can be applied to less than or equal to about 25% of a length of a side edge. The skin contact adhesive is applied to less than or equal to about 30% of a side edge. The skin contact adhesive is applied to less than or equal to about 35% of a side edge. The skin contact adhesive is applied to less than or equal to about 40% of a side edge.

The skin contact adhesive along the top edge of the mask can be applied by any standard methods, for example by spray coating the skin contact adhesive along the top edge of the mask. The skin contact adhesive coating can be applied to most or the entire length of the top edge of the face mask. The skin contact adhesive coating can be applied to more than or equal to about 90%, 85%, 80%, 75%, 70%, 65%, 60%, 55%, or 50% of the top edge of the face mask.

The skin contact adhesive can include, but is not limited to, pressure-sensitive adhesives designed for removable application such as acrylic based and dextrin based adhesives configured for adhesion to a skin region of the user. The adhesive on the top edge of the interior portion can also be water or moisture-resistant, such as any standard used water resistant adhesives, such as a polyacrylate adhesive or polymerization reaction product of two alkyl acrylate or methacrylate ester monomers such as butyl acrylate and ethyl acrylate, with a ethylenically unsaturated carboxylic acid, a vinyl lactum and a crosslinking agent. The skin contact adhesive layer can comprise, for example, a dermal pressure sensitive adhesive based on natural or synthetic elastomers, such as amorphous polyolefins.

In one aspect of the present invention, the skin contact adhesive is hypoallergenic. The skin contact adhesive can be a dermal adhesive. The skin contact adhesive can be a low trauma adhesive. The skin contact adhesive can be non-abrasive. Skin contact adhesives of the present invention include but are not limited to, latex free adhesives, rubber-based adhesives such as butyl-based, acrylic-based adhesives, dextrin-based adhesives, porous adhesives, moisture or water-resistant adhesives, hypoallergenic adhesives, silicone-based adhesives, hydrocolloid adhesives, and pressure sensitive dermal adhesive for removable application.

The skin contact adhesive, the face mask, or both may be sterilized by standard methods and be hypoallergenic. The skin contact adhesive of the present invention can comprise various types of tensile strengths of adhesives configured to 'stick' to an individual or to an item that is placed on an individual. To increase the adhesion between the adhesive layer and the interior surface, a primer can be applied to the interior surface on which the adhesive layer is placed. The bottom edge of the face mask can be substantially free of skin contact adhesive.

Skin Care Agent

The top edge of the interior surface of the mask can comprise a skin care agent consisting of a moisturizer. The skin care agent can be applied to the interior surface of the mask using standard methods, and can be done discontinuously or continuously with the skin contact adhesive layer. The skin care agent can be positioned along the top edge of the mask, preferably along the entire top edge. The skin care agent may also be infused onto the left portion, the right portion, or both, of the interior layer of the face mask positioned principally over the wearer's cheek areas where chaffing and dryness can occur from long-term use of a face mask. In some embodiments, the center portion positioned over the wearer's mouth and nose openings are do not comprise a skin care agent.

Skin care agents can act as moisturizers to protect skin in contact with the mask. Skin care agents can comprise aloes such as aloe vera, honey, hydroxyl acids, and Zinc. Skin care agents can comprise moisturizers such as Vitamin E. Skin care agents can comprise humectants such as hyaluronic acid, glycerin, and ceramides. Skin care agents can comprise occlusives to block the evaporation of water. Skin care agents can include collagen. Anti-inflammatories may also be included in the face mask to protect already injured skin from further degradation. Examples of anti-inflammatories can include salicylic acid, licorice extract, green tea, turmeric, *Centella asiatica*, colloidal oatmeal, chamomile, resveratrol, and glutathione which also may be applied to the inner layer of the face mask. Skin care agents can be separated from, or combined with, the skin contact adhesive on said face mask interior surface.

In another aspect, skin care agents can be applied continuously or discontinuously with the skin contact adhesive. The adhesive composition can be prepared by uniformly mixing the raw materials by a conventional mixing method. For example, the amorphous polyolefins and the skin care agent are mixed with a mixing apparatus such as a homomixer or a planetary mixer to homogeneously dissolve or disperse the materials to obtain the liquid composition. The combined mixture can be applied to the face mask using standard methods.

More broadly, skin contact adhesives and skin care agents of the present invention can be applied by any suitable method, such as, for example, solvent coating in a continuous or discontinuous method, air knife coating, rod coating, electrostatic coating, slide hopper coating, extrusion coating, blade coating, and slide coating where appropriate.

Some embodiments further provide a liner material, or release sheet, which is configured to cover the skin contact adhesive, the skin care agent, or both and keep the skin contact adhesive, the skin care agent, or both, from drying until the user is ready to apply the embodiment to the user's skin. Said liner material can comprise of paper and may also be made of a flexible sheet of at least one of polyethylene film, polyurethane film and the like. The liner can cover the entire skin contact adhesive. The liner paper can be peeled off prior to application to the skin of a user.

Odor Management Mechanism

In yet another aspect therefore, the mask may comprise an odor management mechanism, e.g., a moisture redirection system to minimize odor, to minimize moisture and/or bacteria buildup around the mask closest to the user's nose or mouth, or both. The odor management mechanism can comprise an odor control layer only along, or principally along, the left portion and the right portion of the mask. The odor management mechanism can comprise a metal infused material. In some embodiments the material can be silver infused or copper infused. In some embodiments, the face mask can comprise a stainless steel mesh along an exterior of the face mask.

The odor management mechanism can comprise a woven or non-woven material that can be hydrophilic. The odor management mechanism can be configured to hold at least about 90%, 100%, 110%, 120%, 130%, 140%, 150%, 160%, 170%, 180%, 190%, or 200% of its weight in moisture. The odor management mechanism can comprise a cotton or a cloth such as terry cloth, which are natural polymers and can hold up to about 25 times of its weight in moisture. The odor management mechanism can comprise other absorbent polymers such as sodium polyacrylate or other plastic polymers, or other non-toxic materials that are hydrophilic. The odor management mechanism can be configured to hold at least about 100% of its weight in moisture. The odor management system can comprise natural sponge or sponge made from cellulose wood fibers, for example. The odor management system can comprise non-toxic materials.

The face mask middle layer can be made of a sponge material. The sponge material can be placed to not reach the face mask side edges. The face mask middle layer may not extend vertically to reach the face mask top edge. This placement can provide moisture absorption and odor control along the center portion of the face mask by providing an odor management mechanism, while maintaining the critical lightweight structural design of the middle portion of the face mask interior layer.

In some embodiments, the moisture capture and redirection mechanism may comprise a hydrophilic, non-toxic moisture absorbent material in a middle layer of the face mask. The moisture capture and redirection mechanism may comprise a plurality of hydrophilic, non-toxic moisture absorbent sections coupled with a plurality of hydrophobic elongated depressions along the face mask middle layer that are designed to dissipate air and moisture from the user via the channels, away from the wearer's nose and mouth.

The channels can be parallel or diagonal to one another. The channels can be substantially horizontal. The channels can be physically connected to the absorbent material. The channels can be lined with a hydrophobic material. The channels can be about 1 mm, 2 mm, 3 mm, 4 mm, 5 mm, 6 mm, 7 mm, 8 mm, 9 mm, or about 10 mm in diameter. The channels can be less than about 1 mm, 2 mm, 3 mm, 4 mm, 5 mm, 6 mm, 7 mm, 8 mm, 9 mm, or about 10 mm in diameter. There can be more than about 1, 2, 3, 4, 5, 6, 7 8, 9, 10, 11, 12, 13, 14, 15, 16, 17, 18, 19, 20, 21, 22, 23, 24, 25, 30, 40, 50, 60, 70, or 100 channels. The channels can have a depth of less than about 5 mm, 4 mm, 3 mm, 2 mm, 1 mm, or 0.5 mm.

For example, in some embodiments the face mask can comprise an exterior substrate layer consisting of a polypropylene or polypropylene-based material, an interior layer consisting of a polypropylene or polypropylene-based material, and a middle layer. In some embodiments, the middle layer comprises the odor management mechanism. In some embodiments, the inner layer can comprise a hydrophobic material. In some embodiments, the inner layer can comprise one or more skin care agents.

The moisture redirection system can capture air or moisture created when the user exhales or speaks, and can redirect air or moisture away from the central portion of the face mask and toward the left or right portion of the face mask to minimize moisture build up and odor around the face mask closest to the user's nose or mouth, or both, when the face mask is worn. In some embodiments the face mask can comprise a middle layer comprising a hydrophilic layer. The moisture redirection system can be a part of the face mask middle layer, such as, for example, whereby said middle layer is a cloth or cotton-based material that also has ridges designed to dissipate air and/or moisture when user talks thereby minimizing moisture build-up around a user's nose and/or mouth.

In some aspects, when a user talks, air and droplets can emanate from the wearer's mouth and land on the middle portion of the face mask. With conventional face masks, the moisture stays in the middle portion interior surface and soon begins to emit an odor that the wearer begins to notice. However, the moisture redirection system can provide moisture channels such that the air and droplets can, upon impact on the interior surface, move away from a center portion of the face mask and dissipate to the left portion and/or right portion of the face mask. As a result, the moisture redirection system can minimize moisture buildup around the nose and mouth, minimize odor development and/or minimize bacteria buildup around the nose and mouth, thereby making the face mask a substantially safer face mask than the conventional face mask, particularly for students.

Anti-Microbial Layers

The face mask can comprise an anti-microbial layer. The antimicrobial layer can be a layer comprising silver, copper, or zinc. The anti-microbial layer can be a part of the face mask middle layer, or may be coated onto the exterior layer. The microbial coating can decrease the ability of bacteria, mold, and/or fungi from living and growing on the face mask.

The materials otherwise forming the face mask can be constructed using standard face mask woven or non-woven materials such as, for example, with a non-woven fabric which has better bacteria filtration and air permeability while remaining less slippery than woven cloth. The material can be polypropylene, either 20 or 25 grams per square meter (gsm) in density. Face masks can also be made of polystyrene, polycarbonate, polyethylene, or polyester.

Anti-microbial agents may also be adapted to preferably overlay the exterior layer of the face mask to prevent virus, bacterial or fungal pathogens from penetrating beyond the exterior layer. These anti-microbial agents can include silver, copper and zinc based coatings. Anti-microbial agents can also comprise more aggressive elements such as an organosilane coating, a bactericide, a viral inhibitor, or a fungal inhibitor as the exterior surface will be more exposed to the surrounding exterior environments and can last for a greater period of time. Anti-microbial agents include a bactericide such as gentamicin, cephalothin, carbenicillin, amoxicillin, cefamandolre, tobramycin, vancomycin, chlorohexidine, or derivatives thereof. In addition, these anti-microbial agents include viral inhibitors such as N,N dodecyl, methyl-polyethylenimine or derivatives thereof. Anti-microbial agents can include anti-fungals such as chromogranin, A-derived, antifungal peptides or derivatives thereof.

Dynamic & Retractable Edges With Elastomers

Disclosed herein is also a face mask that can substantially minimize or prevent the top edge of a face mask from dislodging and moving down the wearer's face while verbally communicating while using the face mask. The improved face mask can provide elastomers on the face mask left edge and right edge thereby creating a dynamic face mask bottom half. The need of continually readjusting the face mask when talking is thus minimized and often no longer necessary.

For example, embodiments can comprise an elastomer integrated into the bottom half of the face mask left edge and/or the bottom half of the face mask right edge. The elastomer may be an elastic material, stitched, affixed or otherwise permanently bonded onto a flexible face mask left edge and a separate elastic material stitched, stitched otherwise permanently bonded onto a flexible face mask right edge.

The elastomer can be structurally designed to expand and contract. The elastic material can allow the face mask to expand when the wearer opens his or her mouth with only minimal or no movement of the face mask top edge, and automatically contract the face mask left edge and right edge to its original position when the wearer stops speaking and closes his or her mouth.

Suitable materials for the elastomer can expand and contract substantially more than the surrounding material forming the face mask exterior surface. More specifically, an elastomer can be able to expand at least by a factor of 2 from its original length to allow the face mask left edge and right edge to expand at least 1 centimeter when the wearer opens his or mouth and contract back substantially to its original position when the wearer's mouth is closed. More preferably, the material forming the elastomer can stretch to a factor of 5 and so that the left edge and right edge can expand at least about 2 centimeters. A material incapable of expanding and subsequently contracting at least 1 centimeter and back to its original position would not work as an acceptable elastomer.

The elastic material can stretch by up to a factor of ten from its original length, and when released, can return very nearly to its original length. The elastic material can comprise a rubber and/or elastomer. The elastic material can be of substantial size to extend across and can be permanently secured to at least a portion of the left edge and/or the right edge, respectively. The length of the elastic material can be at least 1 cm, 2 cm, 3 cm, 4 cm, 5 cm, 6 cm, 7 cm, 8 cm, 9 cm, 10 cm, or more on each side edge of the face mask. The elastic material can be permanently secured by any standard methods such as by stitching, permanently bonding or gluing the elastic material onto the face mask material forming the exterior or interior layers. In some instances the face mask earloop can be integrally formed with the elastomer provided that the earloop is formed of an elastomer and is permanently affixed as herein described.

As described herein, elastomers comprise elements that stretch immensely when stressed and immediately return to their original state when the stress has ceased.

The face mask left edge and right edge can be constructed of a flexible material that can be folded and unfolded, crimped or otherwise compacted together and then uncrimped by the elastomer secured to the face mask left edge and right edge material. The elastomer secured to the face mask left edge and right edge would be prevented from expanding and contracting if the material forming the face mask left edge and right edge were of rigid, inflexible material.

UV-Absorbers

The face mask can be coated with UV-absorbers to protect the student's skin from harmful sun rays. Ultraviolet Protection Factor (UPF) is a measure of level of protection a product provides users from UVA and UVB skin damage. In some embodiments, the face mask comprises a UPF rating of at least fifteen. The face mask can comprise a coating on the exterior layer of non-toxic UV-absorbers such as titanium dioxide or Zinc Oxide, a natural UV-Absorber. UV-absorbers can comprise plant-basic oils, for example LUMINORA. The face mask can comprise UV reflectors on the exterior of the face mask.

Ear Padding

The face mask may provide protective properties for the wearer's ear in the form of a padded layer or layers on each earloop to prevent or protect an injury. Padded layers can be formed of conventional materials for dissipating pressure across a surface area. Padded layers can have varying densities and thicknesses. Padded layers can be in the form of a layer or multiple layers.

The padded layer on each face mask earloop can be positioned such that it preferably covers at least a portion of the dorsal or back of the wearer's ear where tension from the face mask earloop is the highest. The padded layer can be located throughout the contact points between the face mask earloop and the wearer's ears. The padded layer can extend 0.1 inches, 0.2 inches, 0.3 inches, 0.4 inches, 0.5 inches, 0.6 inches, 0.7 inches, 0.8 inches, 0.9 inches, 1 inch, 2 inches, 3 inches, or more along each earloop. The padded layer can provide shock absorbance and protection to contact points of a user's face and/or ears. The padded layer can be secured to each earloop by any standard method, such as by stitching. The padded layer can be one uniform cushion, for example, formed of a foam each at least about 3 millimeters in height, each encased in separate, preferably flexible materials, such as flexible plastics or synthetic cottons.

The padded layer can be flexible. The padded layer can be compressible. The padded layer can be resilient. The padded layer can comprise of, for example, any foam or cotton-based fabrics, cloth paddings, such as a cushion, foams such as a polyurethane foam pad. The padded layer can also comprise foam-filled segments, such as polyethylene foam pads, or it can be of cotton or cloth, or gels. For example, the padded layer may comprise of a unitary pad or pad segments, and may comprise any open cell or closed cell foam, such as BOLLARD foam, polyolefin foam and the like. The padded layer may also be made of gels, cotton or other natural or synthetic wadding materials. Additionally, the padded layer may comprise of foam possessing a substantially uniform cell distribution or polyvinyl chloride foam plastic.

Face mask embodiments may also comprise of an electrostatically charged material, such as an electrostatically charged middle layer for example, to further increase the filtration of particles such as bacteria.

In some aspects, a 20 gsm mask material can be made in a spun bond process, which involves extruding the melted plastic onto a conveyor. The material can be extruded in a web, in which strands bond with each other as they cool. A 25 gsm fabric can be made through melt blown technology, which is a similar process where plastic is extruded through a die with hundreds of small nozzles and blown by hot air to become tiny fibers, again cooling and binding on a conveyor. These fibers are less than a micron in diameter.

The face masks can be made up of a multi-layered structure, generally by covering a layer of textile with non-woven bonded fabric on both sides. Non-woven materials can be made with three or four layers. The masks can be made with two filter layers effective at filtering out particles such as bacteria above 1 micron. The filtration level can depend on the fiber, the web's structure, and the fiber's cross-sectional shape. The face masks can be made on a machine line that assembles the nonwovens from bobbins, ultrasonically welds the layers together, and stamps the masks with nose strips, ear loops, and other pieces, or other standard methods. The face masks can be sterilized.

Figure 2:
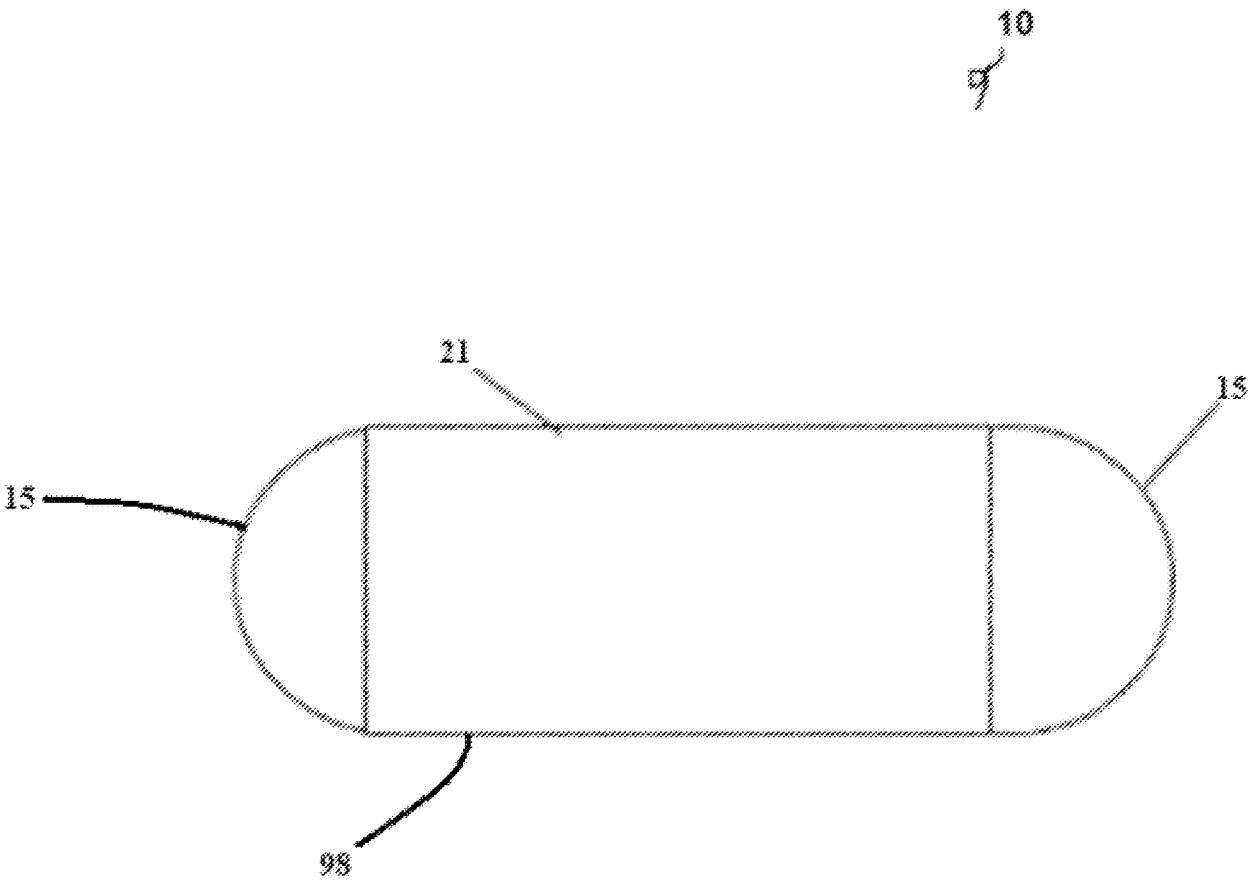
FIG. 2 is an exterior view of the face mask of FIG. 1.
Figure 3:
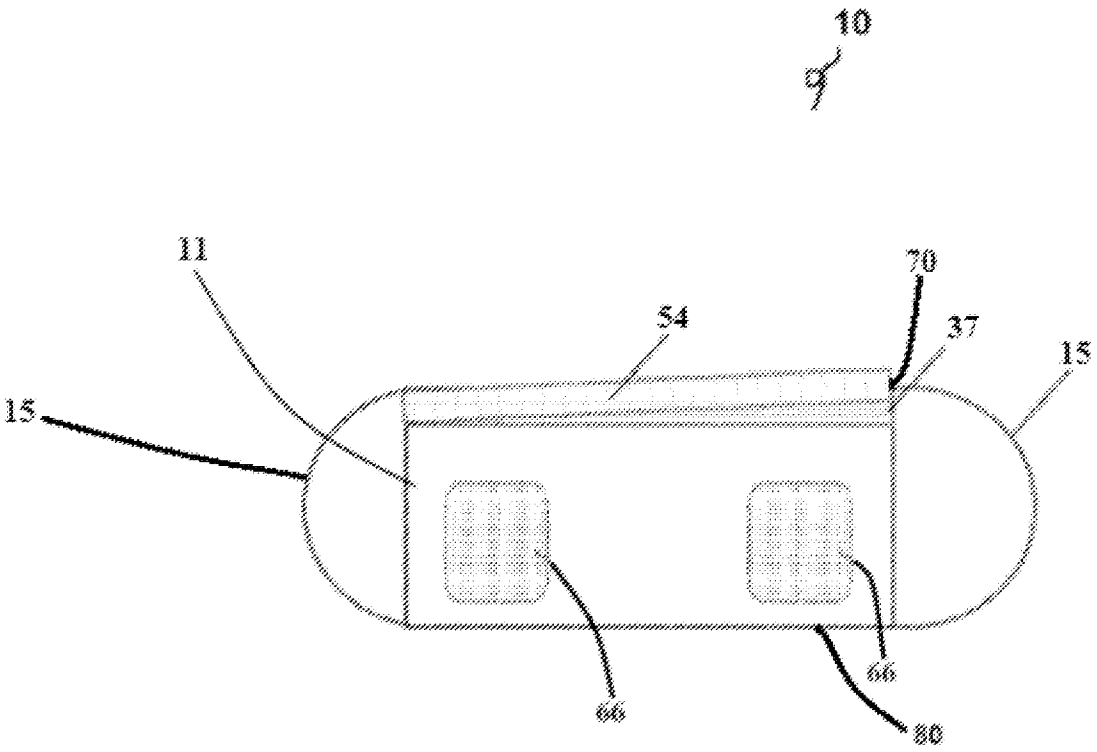
FIG. 3 illustrates the face mask of FIG. 1, showing the contact release sheet as well as the front and back surface of the odor management mechanism.

Now referring to FIG. 1, FIG. 2, and FIG. 3, the present invention is illustrated as a drawing of a first embodiment 10, showing both an interior surface view 11 and an exterior surface view 21. The embodiment is a surgical face mask which is formed of multiple fiber layers. The interior layer surface 11 view is drawn in FIG. 1. The exterior layer surface 21 view is drawn in FIG. 2. The interior layer surface 11 view also showing the contact release sheet 54 is drawn in FIG. 3.

For example, the face mask comprises an exterior substrate layer comprising of a standard surgical face mask material such as a polypropylene or polypropylene-based material, an interior layer comprising of a standard surgical face mask material such as of a polypropylene or polypropylene-based material, and a middle layer 80. The surgical face mask is designed for use by an individual. The interior layer surface makes contact with the skin of the user, and the exterior layer whose surface is visually seen by others. The face mask has a top edge, a bottom edge, a center portion, a left portion, and a right portion. This multi-ply designed face mask is of substantial size to overlay the entire mouth and at least a portion of the user's nose when the face mask is worn.

The face mask can have two earloops 15 that the user uses to hang the face mask on the user's ears. The earloops can be made of an elastic material. The earloops can comprise rubber. The earloops can be formed of the same material as the face mask. The earloops can be integrally formed from the same material as the face mask. The earloops can be attached to the face mask by a rivet, stitch, adhesive, etc.

The embodiment further consists of a skin contact adhesive layer 37 along the top edge of the interior surface of the mask. The skin contact adhesive layer creates an adhesive surface for application on a skin of the user's face and therefore can be configured to be adhered to the skin of the user. The embodiment provides a unique and substantially improved face mask that prevents air from escaping through the top edge of the face mask by adhering the top edge of the face mask to the skin of the user's face, and, as a result substantially prevents the user's eyewear from fogging when the mask is worn. The skin contact adhesive can be positioned along the top edge of the face mask, for example along the entire top edge of the interior surface.

The skin contact adhesive along the top edge of the face mask can be applied by any standard methods, such as by spray coating the skin contact adhesive along the top edge of the mask. The skin contact adhesive coating covers most or the entire length of the top edge of the face mask. The width of the adhesive coated portion may vary by desired adhesive. Generally, the width covered by the skin contact adhesive may range from 2% to 20% of the face mask.

The skin contact adhesive can be adapted for adhesion onto the skin of the user to prevent injury to the skin of the user. The skin contact adhesives can include pressure sensitive adhesives, such as a low trauma latex-free adhesives. To minimize irritation or allergic reactions, the face mask can comprise hypoallergenic materials. The face mask can be sterilized prior to use.

The interior surface of the mask can comprise a skin care agent 70 such as a moisturizer. The skin care agent can be applied to the interior surface of the mask using standard methods, and can be done discontinuously or continuously with the skin contact adhesive layer. The skin care agent is positioned along the top edge of the mask, such as along essentially the entire top edge of the interior surface.

The skin care agent acts as a moisturizer to protect and even improve skin, and comprises of aloes, such as aloe vera, honey, hydroxyl acids, hyaluronic acid, glycerin, ceramides, Vitamin E, and Zinc. The agent may be separated from, or combined with the skin contact adhesive on said face mask interior surface. The face mask can additionally comprise an anti-inflammatory agent 98. The anti-inflammatory agent can comprise salicylic acid, licorice extract, green tea, turmeric, *Centella asiatica*, colloidal oatmeal, chamomile, reservatrol, or derivatives thereof.

As aforementioned, the skin care agent may be applied continuously or discontinuously with the skin contact adhesive, and prepared by any standard methods. For example, the adhesive composition may be prepared by uniformly mixing the raw materials by a conventional mixing method. For example, the amorphous polyolefins and the skin care agent are mixed with a mixing apparatus such as a homomixer or a planetary mixer to homogeneously dissolve or disperse the materials to obtain the liquid composition. The combined mixture is then applied using standard methods.

As can be seen in FIG. 3, the embodiment also further provides a liner material or a release sheet 54, which is configured to cover the skin contact adhesive 37, the skin care agent 70, or both and keep the skin contact adhesive, the skin care agent, or both, from drying until the user is ready to apply the embodiment to the user's skin. The release sheet can comprise of paper and may also be made of a flexible sheet of at least one of polyethylene film, polyurethane film and the like, and covers the entire skin contact adhesive to preserve the adhesive layer until the wearer is ready to adhere the mask to the user's skin as the user may wear the mask without activating—or exposing the adhesive layer immediately. The release sheet paper is peeled off of the embodiment by the wearer exposing the adhesive 37 for application to the wearer's skin. Once the interior surface of the mask is adhered to the wearer's face via the skin contact adhesive layer, subsequent exhaled air from the wearer is prevented from escaping through the mask top edge and, as a result, prevents the wearer's eyewear from fogging up.

The embodiment also shows a unique odor management mechanism or a moisture redirection system to minimize odor to minimize moisture and bacteria buildup around the mask closest to the user's nose or mouth, or both.

The odor management mechanism comprises of an odor control layer 66 only along, or principally only along, the left portion and right portion of the mask. The odor control layer 66 can comprise a moisture absorbent layer.

For example, the aforementioned structure of the embodiment comprises an exterior substrate layer comprising of a polypropylene or polypropylene-based material, an interior layer comprising of a polypropylene or polypropylene-based material, and a middle layer.

The middle layer can comprise the odor management mechanism 66 comprising of a woven or non-woven material. The odor management mechanism can comprise a hydrophilic material. The hydrophilic material can be configured to hold at least 100% of its weight in moisture such as a sponge material. The mask middle layer made of a sponge material is of substantial size to overlay essentially the entire mouth of the wearer but not extend substantially beyond it. The odor management mechanism can comprise a sponge material that does not extend laterally to reach the mask side edges and does not extend vertically to reach the mask top edge.

Figure 4:
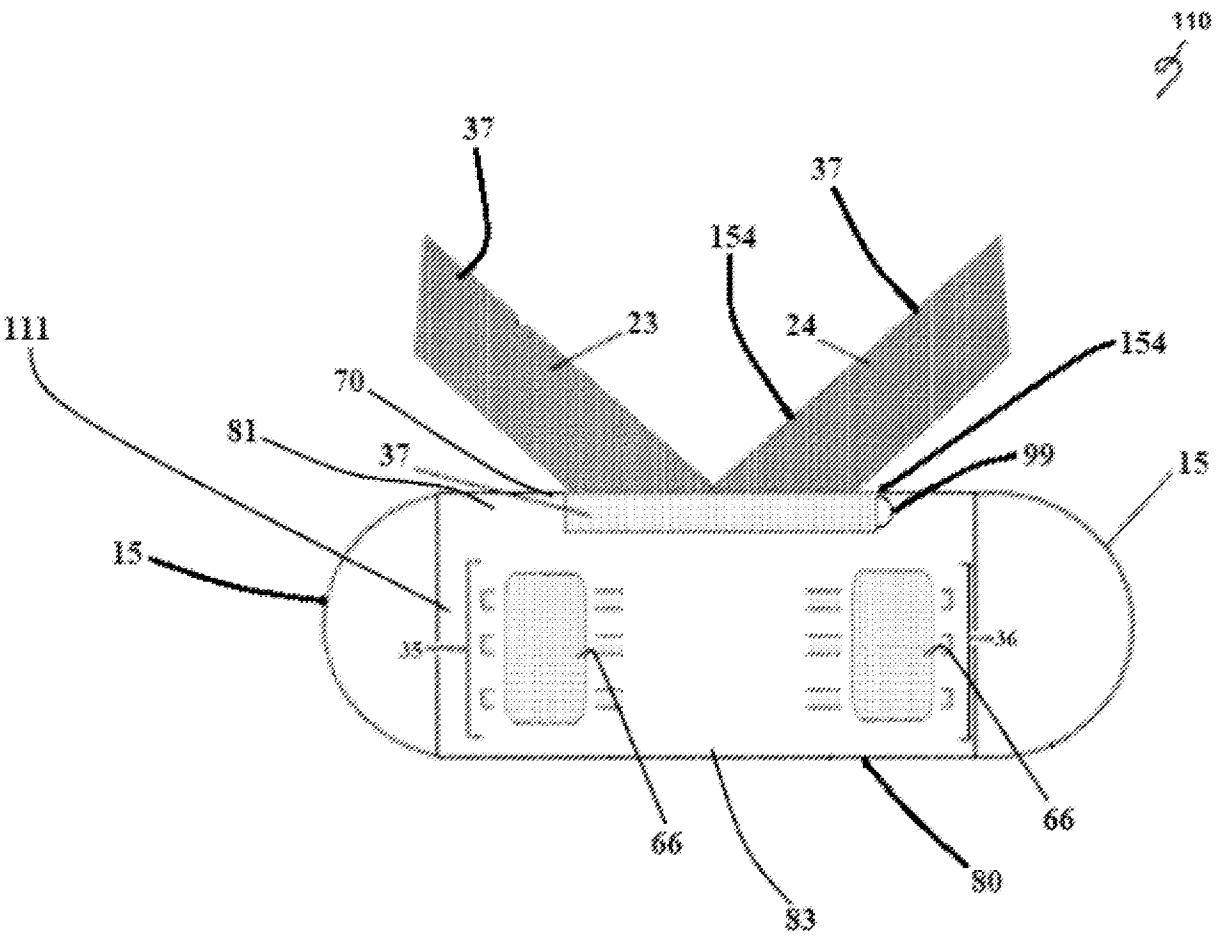
FIG. 4 illustrates a face mask with two wings configured to overlay a user's zygomatic bones.
Figure 5:
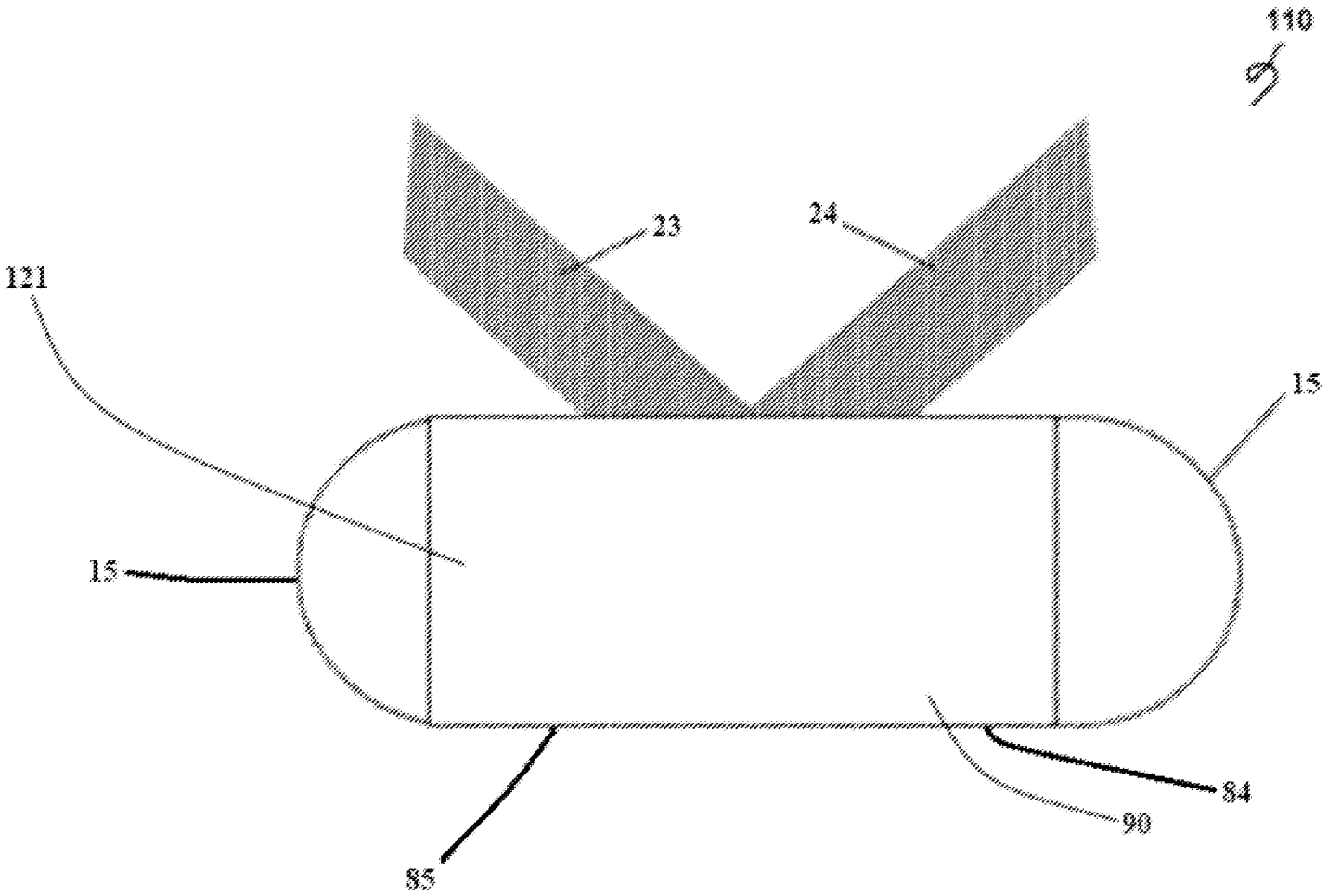
FIG. 5 is an exterior drawing of the face mask of FIG. 4.
Figure 6:
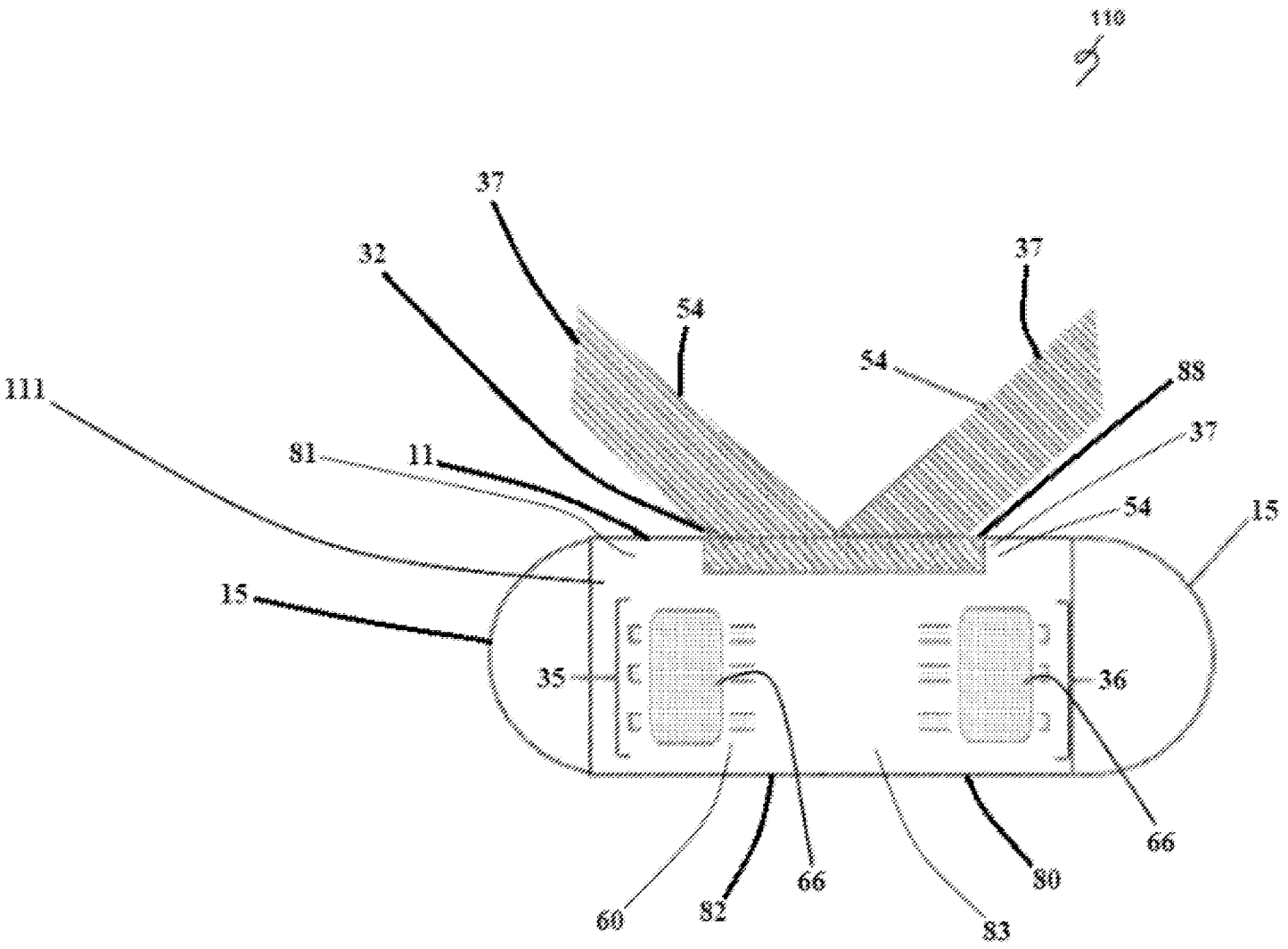
FIG. 6 illustrates the face mask of FIG. 4 showing the contact release sheet as well as the surface of the odor management mechanism.

Now referring to FIG. 4, FIG. 5 and FIG. 6, the present invention is illustrated as a drawing of a second embodiment 110, showing both an interior surface view 111 and an exterior surface view 121. The embodiment is a face mask which is formed of multiple fiber layers. The interior layer surface 111 view is drawn in FIG. 4. The exterior layer 121 can be seen in FIG. 5.

FIG. 6 shows a middle layer view shows horizontal channels along an interior layer of the mask, 35 and 36, which channel moisture away from the face mask middle portion overlaying the user's nose and mouth.

For example, the face mask comprises an exterior substrate layer comprising of any materials aforementioned, such as, for example a standard surgical face mask material such as a polypropylene or polypropylene-based material, an interior layer comprising of a standard surgical face mask material such as a of a polypropylene or polypropylene-based material, and a middle layer 80. The surgical face mask is designed for use by an individual. The interior layer surface makes contact with the skin of the user, and an exterior layer whose surface is visually seen by others. The face mask has a top edge 81, a bottom edge 82, a center portion 83, a left portion 84, and a right portion 85. This multi-ply designed face mask is of substantial size to overlay the entire mouth and at least a portion of the user's nose when the face mask is worn.

The face mask has two earloops 15 that the user uses to hang the face mask on the user's face, and is made of an elastic material.

The embodiment has a two wing portions 23, 24 that extend out from the face mask to overlay both of the wearer's zygomatic bones. The wing portions are designed to extend and adhere to each side of the wearers face such that the wearer's nose reside between each of the two winged portions of the embodiment.

The embodiment further provides a skin contact adhesive layer 37 along the top edge of the interior surface of the mask. The skin contact adhesive layer creates an adhesive surface for application on a skin of the user's face and therefore can be configured to be adhered to the skin of the user. The embodiment provides a unique and substantially improved face mask that addresses this problem by substantially preventing air to escape from the top edge of the face mask by adhering the top edge of the face mask to the skin of the user's face, and, as a result substantially prevents the user's eyewear from fogging when the mask is worn.

The skin contact adhesive can be positioned along the top edge of the mask as well as along the interior surface of the two wing portions. The skin contact adhesive 37 can be applied by any standard methods, such as any aforementioned. The skin contact adhesive is coated throughout the entire interior surface of each of the two winged portions 23, 24 of the embodiment. An important aspect of the present invention is that the skin contact adhesive can be adapted for adhesion onto the skin of the user. As long as this requirement has been met, skin contact adhesives include pressure sensitive adhesives, such as such as an acrylic-based adhesives, rubber-based adhesives such as butyl-based, silicone-based adhesives, porous adhesives, moisture or water-resistant adhesives, hypoallergenic adhesives, and pressure sensitive dermal adhesive designed for removable application.

To minimize irritation or allergic reactions, the skin contact adhesive, the face mask, or both may be configured to be hypoallergenic. The contact adhesive may also be sterilized. The skin contact adhesive of the present invention can comprise various types of tensile strengths of adhesives configured to removably attach to an individual or to an item that is placed on an individual. Having the two wing portions significantly increases the adhesion of the embodiment onto the face of the wearer.

The embodiment interior surface can also comprise a skin care agent consisting of a moisturizer. The skin care agent can be applied to the interior surface of the two wing portions. The skin care agent can be applied discontinuously or continuously onto the mask. The skin care agent 70 can be applied with the skin contact adhesive layer or can be applied under the skin contact adhesive layer.

The skin care agent is positioned along the top edge of the embodiment, such as along essentially the entire interior surface of the first wing portion and the second wing portion.

The skin care agent acts as a moisturizer to protect and even improve skin, and comprises of aloes, such as aloe vera, hydroxyl acids, honey, and Zinc. The agent can be separated from or combined with, the skin contact adhesive on said face mask interior surface by any standard methods.

The face mask can comprise a liner material or a release sheet 154, which is configured to cover the skin contact adhesive 37, the skin care agent, or both and keep the skin contact adhesive, the skin care agent, or both, from drying until the user is ready to apply the embodiment to the user's skin. The release sheet can comprise of paper, and may also be made of a flexible sheet of at least one of polyethylene film, polyurethane film and the like, and covers the entire skin contact adhesive to preserve the adhesive layer until the wearer is ready to adhere the mask to the user's skin as the user may wear the mask without activating—or exposing the adhesive layer immediately. The release sheet paper is peeled off of the embodiment by the wearer exposing the adhesive for application to the wearer's skin. Once the interior surface of the mask is adhered to the wearer's face via the skin contact adhesive layer, subsequent exhaled air from the wearer is prevented from escaping through the mask top edge and, as a result, prevents the wearer's eyewear from fogging up. The release sheet can comprise a tab 99 that can extend beyond the adhesive so that the wearer can easily detach the release sheet from the adhesive layer in an efficient manner.

The face mask can comprise an odor management mechanism 66 or a moisture redirection system 60 to minimize to minimize moisture and bacteria buildup around the mask closest to the user's nose or mouth, or both. As can be seen in FIG. 6, the moisture redirection system 60 can comprise diagonal channels along middle layer or an interior layer of the mask, 35 and 36, which channel moisture away from the user's nose and mouth.

The odor management mechanism 66 can comprise an odor control layer principally along the left portion and right portion of the mask such as a moisture absorbent layer on the mask, for example.

For example, the aforementioned structure of the embodiment may comprise an exterior substrate layer comprising, for example, of a polypropylene or polypropylene-based material, an interior layer comprising of a polypropylene or polypropylene-based material, and a middle layer, for example.

The middle layer can comprise the odor management mechanism 66 comprising of a woven, or non-woven material that is hydrophilic and can be configured to hold at least 100% of its weight in moisture such as a cotton or a cloth, sodium polyacrylate or other plastic polymers, and other non-toxic materials that are hydrophilic and are configured to hold at least 100% of its weight in moisture such as natural sponges or sponges made from cellulose wood fibers. The mask middle layer can be made of a cotton absorbent material of substantial size to overlay essentially the entire mouth of the wearer but not extend substantially beyond it. In other words, the sponge material may not extend laterally to reach the mask side edges.

Figure 7:
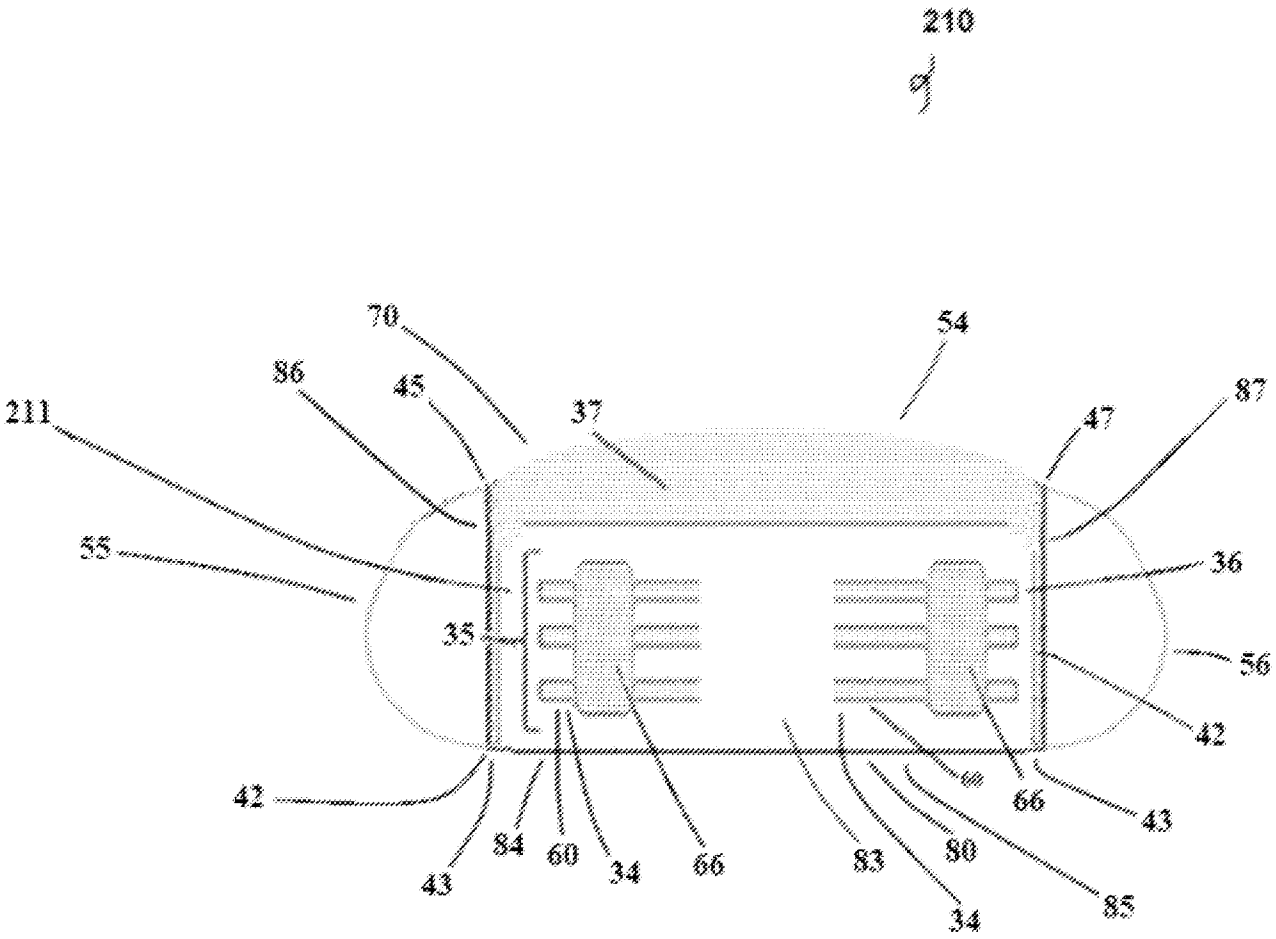
FIG. 7 illustrates an interior view of a face mask with a wide contact adhesive surface area at the top of the mask.
Figure 8:
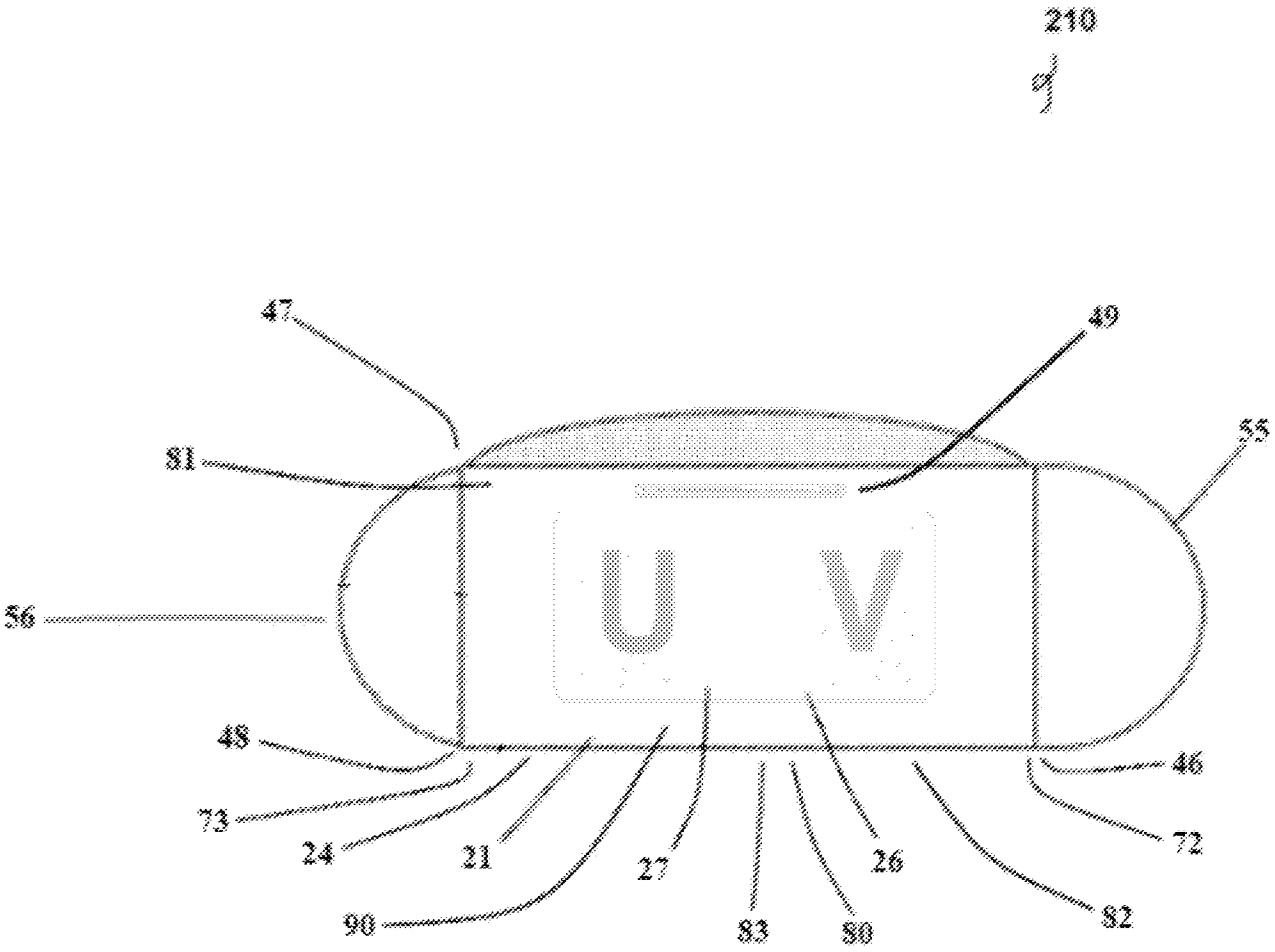
FIG. 8 is an exterior view of the face mask of FIG. 7.

Now referring to FIG. 7 and FIG. 8, the present invention is illustrated as a drawing of a third embodiment 210 showing both an interior surface view 211 and an exterior surface view 21. The embodiment is a surgical face mask which is formed of multiple fiber layers. The interior layer surface 211 view is drawn in FIG. 7. The exterior layer, 21 can be seen in FIG. 8.

For example, the face mask can comprise an exterior substrate layer comprising of a standard surgical face mask material such as a non-woven fabric such as a polypropylene or polypropylene-based material, an interior layer comprising of a standard surgical face mask material such as a of a polypropylene or polypropylene-based material, and a middle layer 80. The surgical face mask is designed for use by an individual. The interior layer surface makes contact with the skin of the user, and an exterior layer whose surface is visually seen by others. The face mask has a top edge 81, a bottom edge 82, a center portion 83, a left portion 84, and a right portion 85. This multi-ply designed face mask is of substantial size to overlay the entire mouth and a substantial portion of the user's nose when the face mask is worn. The face can have two earloops 55, 56 that the user uses to hang the face mask on the user's ears.

The face mask can comprise a skin contact adhesive layer 37 along the top edge of the interior surface of the mask. The skin contact adhesive layer can be configured to be adhered to the skin of the user. The embodiment provides a unique and substantially improved face mask substantially preventing air from escaping through the top edge of the face mask by adhering the top edge of the face mask to the skin of the user's face, and, as a result substantially prevents the user's eyewear from fogging when the mask is worn.

The skin contact adhesive layer 37 is positioned essentially along the entire top edge of the interior surface of the mask. Additionally, the adhesive extends down along a small portion of each side edge 86, 87 of the face mask but preferable not more than about twenty-five percent. In some embodiments, at least about forty percent, about fifty percent, or about sixty percent of each side edge is free of any skin contact adhesives.

The skin contact adhesive along the top edge of the mask can be applied by any standard methods, such as by any aforementioned. The skin contact adhesive coating covers essentially the entire length of the top edge of the face mask.

The skin contact adhesive can comprise pressure sensitive adhesives, such as such as hydrocolloid adhesives, which are moisture resistant and can provide adhesion to the user's skin over an extended period of time and/or in humid conditions.

The interior surface of the mask can comprise a skin care agent such as a moisturizer. The skin care agent can be applied to the interior surface of the mask using standard methods, and can be done discontinuously or continuously with the skin contact adhesive layer. The skin care agent 70 can be positioned along the top edge of the mask, such as along essentially the entire top edge of the interior surface, extending down a portion of each side edge of the face mask.

The skin care agent can act as a moisturizer to protect and improve skin. The skin care agent can comprise humectants or ceramides. Ceramides are particularly useful in reinforcing the natural barrier on one's face. The skin care agent may be separated from the skin contact adhesive. The skin care agent can be combined with the skin contact adhesive on said face mask interior surface by any standard methods.

The face mask can comprise a liner material or a release sheet, which is configured to cover the skin contact adhesive 37, the skin care agent, or both and keep the skin contact adhesive, the skin care agent, or both, from drying until the user is ready to apply the embodiment to the user's skin. The release sheet can comprise of paper, and may also be made of a flexible sheet of at least one of polyethylene film, polyurethane film and the like, and covers the entire skin contact adhesive to preserve the adhesive layer until the wearer is ready to adhere the mask to the user's skin as the user may wear the mask without activating—or exposing the adhesive layer immediately. This can be helpful during severe weather whereby the wearer can choose to substantially maintain the face mask from moving along the top edge—by removing the release sheet and applying the exposed skin contact adhesive onto the wearer's face—or deciding to keep the face mask more loosely hanging on the wearer's face by not removing the release sheet. The release sheet paper is peeled off of the embodiment by the wearer exposing the adhesive for application to the wearer's skin. Once the interior surface of the mask is adhered to the wearer's face via the skin contact adhesive layer, subsequent exhaled air from the wearer is prevented from escaping through the mask top edge and, as a result, prevents the wearer's eyewear from fogging up.

The embodiment may also comprise an odor management mechanism 66 or a moisture redirection system 60 to minimize to minimize moisture and bacteria buildup around the mask closest to the user's nose or mouth, or both. As can be seen in FIG. 7, the moisture redirection system 60 can comprise horizontal channels along an interior layer or a middle layer of the mask, 35 and 36, which channel moisture away from the user's nose and mouth. The odor management mechanism 66 can comprise an odor control layer only along, or principally only along, the left portion and right portion of the mask such as an anti-microbial layer or a moisture absorbent layer on the mask, for example. The anti-microbial layer can comprise silver, copper, or zinc to minimize bacteria, viral, or fungal build-up.

For example, the aforementioned structure of the embodiment may comprise an exterior substrate layer comprising of a polypropylene or polypropylene-based material, an interior layer comprising of a polypropylene or polypropylene-based material, and a middle layer.

The middle layer can comprise an odor management mechanism 66 comprising a woven, or non-woven material that can be hydrophilic and can be configured to hold at least 100% of its weight in moisture, such as a cotton-based absorbent material. The mask middle layer made of a cotton-base absorbent material is of substantial size to overlay the at least 10%, 20%, 30%, 40%, 50%, 60%, or 70% of the surface area of the face mask.

The exterior layer of the face mask can comprise an anti-microbial agent. The exterior layer can comprise an anti-microbial material 90 configured to protect the wearer from pathogens that may collect on the exterior surface of the face mask. The anti-microbial agent can comprise any anti-microbial agent described herein, for example, silver, copper, zinc. The exterior surface of the face mask can comprise an anti-viral agent.

The face mask has a top edge, a bottom edge, a center portion, a left portion, and a right portion 85, as well as a left side edge 72 and a right side edge 73. This multi-ply designed face mask can be of substantial size to overlay the entire mouth and at least a portion of the user's nose when the face mask is worn. FIG. 1 shows the facemask in the unfolded position. The facemask can be constructed of flexible material such that the face mask may be folded to allow for an expandable center portion for easier breathing when the face mask is worn.

The face mask as shown in FIG. 1 is in the unfolded position but is constructed of flexible material such that the face may be folded to allow for an expandable center portion for easier breathing when the face mask is worn. The face mask can comprise a standard bendable nosepiece element 49.

The face mask can have two earloops 55, 56 made of an elastic material and designed to extend around the wearer's ears so that the face mask hangs on the user's ears.

The face mask can comprise an elastomer 43 along the left edge and the right edge of the face mask. As aforementioned, the elastomer is preferably an elastic material 42. A first elastic material can be permanently secured along at least most of the face mask left edge and a second elastic material permanently secured along most of the face mask right edge. The elastomer on the face mask left edge and right edge is permanently secured to the face mask body by any standard methods, such as by glue, ultrasonic bonding or stitching onto the face mask interior surface material forming the left edge, right edge and bottom edge. The elastomer is positioned along the face mask left edge and right edge and is structured to expand the face mask left edge and right edge when stress is applied to the bottom portion of the face mask such as when the wearer's jaw drops when speaking, and immediately return the face mask left edge and right edge back to their original position when the stress has ceased and the wearer closes his or her mouth. The elastic material 42 can be structurally designed to expand and contract as aforementioned and defined. For example, the elastic material can allow the face mask to expand when the wearer opens his or her mouth without essentially moving the face mask top edge, and contract the face mask left edge and right edge to essentially its original position when the wearer stops speaking.

The elastic material can be secured to the face mask edges while under tension so that when in a relaxed state if it folds or crimps the face mask left edge and right edge to position left edge and right edge snugly on the wearer's face. The material forming the face mask left edge and right edge can therefore be primarily or entirely flexible, non-rigid so to have the critical flexibility required in a dynamic face mask bottom half. The elastic material can be in a relaxed state but when stress can be imposed on it by the wearer's dropped jaw the elastic material, now under tension, expands moving the face mask bottom half without out essentially moving the face mask top edge and thus minimizing or eliminating the need to manually having to reposition the face mask when talking.

The elastomer can overlay at least most of the lower half of the face mask left edge as well as at least most of the lower half of the right edge. As such, the length should be at least about two centimeters to adequately function as intended. The length maximums will vary. An elastic length of less than two centimeters would begin to frustrate the intended function of significantly expanding the face mask left edge and right edge when the wearer speaks.

The face mask left edge 72 and right edge 73 can be constructed of a flexible material that can be folded and unfolded or crimped together and then uncrimped. An elastomer secured to the face mask left edge and right edge would be prevented from expanding and contracting if the material forming the face mask left edge and right edge were of rigid, inflexible material. A rigid face mask left edge and right edge would therefore prevent the present invention for performing its intended function.

The first end of an earloop can be secured on or near the face mask top left edge 45 while the second end can be secured on or near the face mask bottom left edge 46, for example along an interior surface of the face mask. The first elastomer can be secured below the first earloop first end and above the first earloop second end of the face mask left edge. The second earloop can be positioned such that the first end of the second earloop can be secured on or near the face mask top right edge 47 and the second end of the second earloop can be secured on or near the bottom right edge 48 of the face mask. The second elastomer can be secured below the second earloop first end and above the second earloop second end of the face mask right edge. Securing can be accomplished by any standard methods such as by stitching, ultrasonic bonding or hot gluing for example. Having flexible earloops secured at both ends of the face mask are substantially superior than having a strap or straps wrapped around the entire head and only positioned above the wearer's ears; the lack of a strap below the ear and secured on or near the bottom edge as provided by earloops would substantially diminish the face mask bottom half from lowering and subsequently snapping back to essentially its original position as the wearer's jaw drops and rises when speaking.

The earloop and the transverse elastomer may be separate pieces or may be integral 58 with each other provided the earloop can be formed of an elastomer as herein defined. For example, the elastomer and each earloop could be formed and molded as one piece formed of an elastomer using an elastomer yarn 55, 56.

The face mask can comprise protective properties for the wearer's ear in the form of a padded layer or layers on each earloop to prevent irritation or injury. Padded layers can be formed of conventional materials for dissipating pressure across a surface area, can have varying densities and thicknesses, and can be in the form of a layer or multiple layers. The padded layer on each face mask earloop can be positioned such that it preferably covers at least a portion of the dorsal or back of the wearer's ear where tension from the face mask earloop can be the highest. The padded layer can be positioned throughout the contact points between the face mask earloop and the wearer's ears, extending up to as much as about one to three inches along each earloop. The padded layer provides substantially higher shock absorbency and protection than the material forming the earloop. The padded layer can be therefore secured to each earloop by any standard method, such as by stitching or hot gluing. The padded layer can be one uniform cushion, for example, formed of a foam each at least about three millimeters in height, each encased in separate, preferably flexible materials, such as flexible plastics or synthetic cottons.

The face mask can comprise a plurality of elongated depressions comprising channels on the face mask interior or middle layer 35, 36 which channel moisture away from the user's nose or mouth. The channels either consist of or are coated with a hydrophobic coating 34 so that moisture will not get trapped in the channels via being absorbed by the channels.

The face mask can also comprise of an electrostatically charged material 24, such as an electrostatically charged middle layer for example, to further increase the filtration of particles such as bacteria. The face mask exterior surface layer can comprise an anti-microbial element 90 as described herein.

The face mask can be coated with UV-absorbers 26 to protect the wearer's skin from harmful sun rays, on the face mask exterior surface during P.E. and recess, for example. The face mask can be constructed to provide a UPF rating of at least fifteen by coating the face mask exterior layer with non-toxic UV-absorbers such as titanium dioxide or Zinc Oxide, a natural UV-Absorber. More recently, UV-absorber coatings in the form of plant-basic oils 27 have been developed, such as LUMINORA UV protection which blocks UV rays and has been shown to achieve a UPF rating as high as fifty. UV reflectors would also be a suitable element of the UPF coating.

Figure 9:
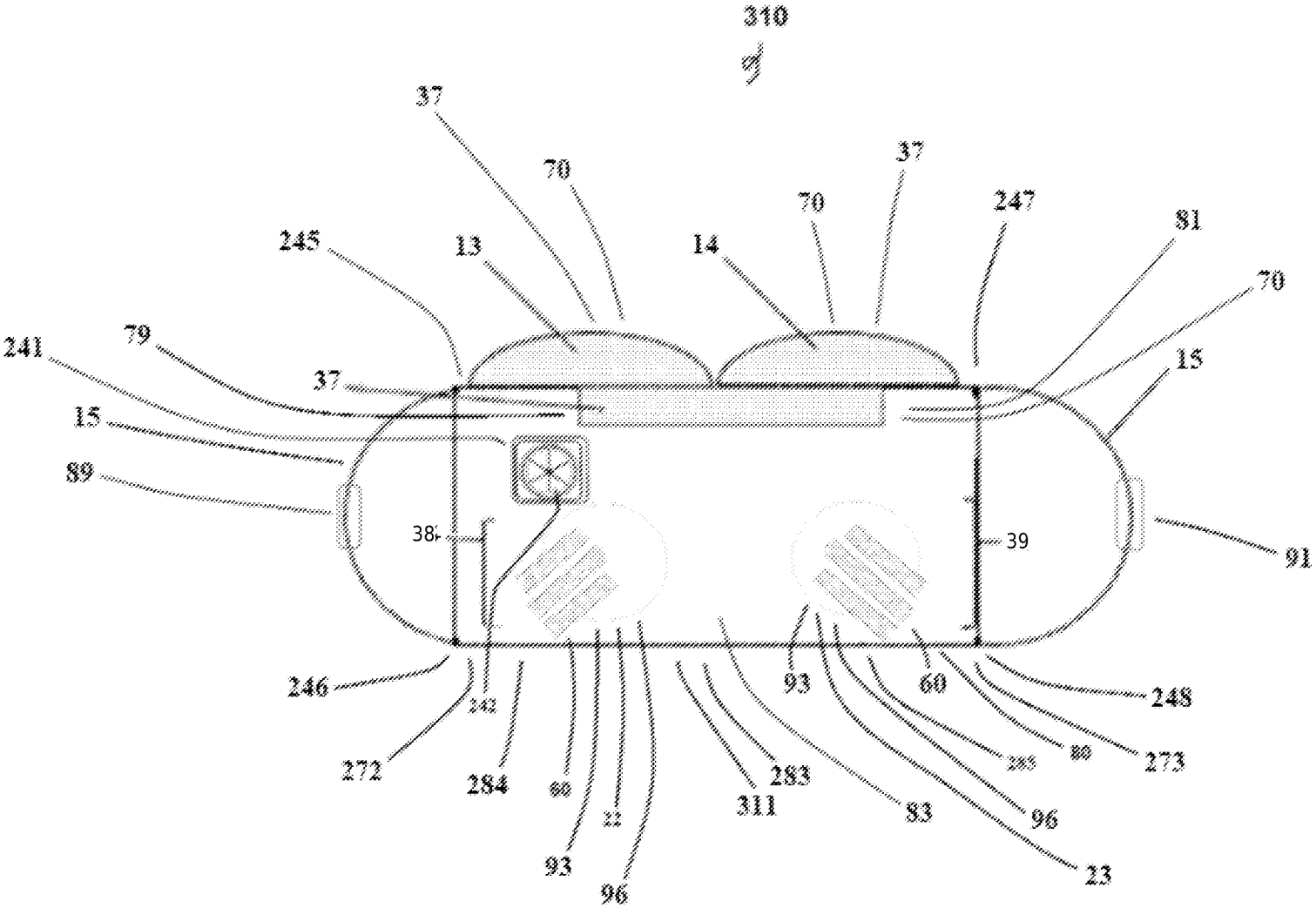
FIG. 9 illustrates an interior view of a reusable cloth face mask with two contact adhesive surface areas at the top of the mask as well as an exhalation valve or filter device.
Figure 10:
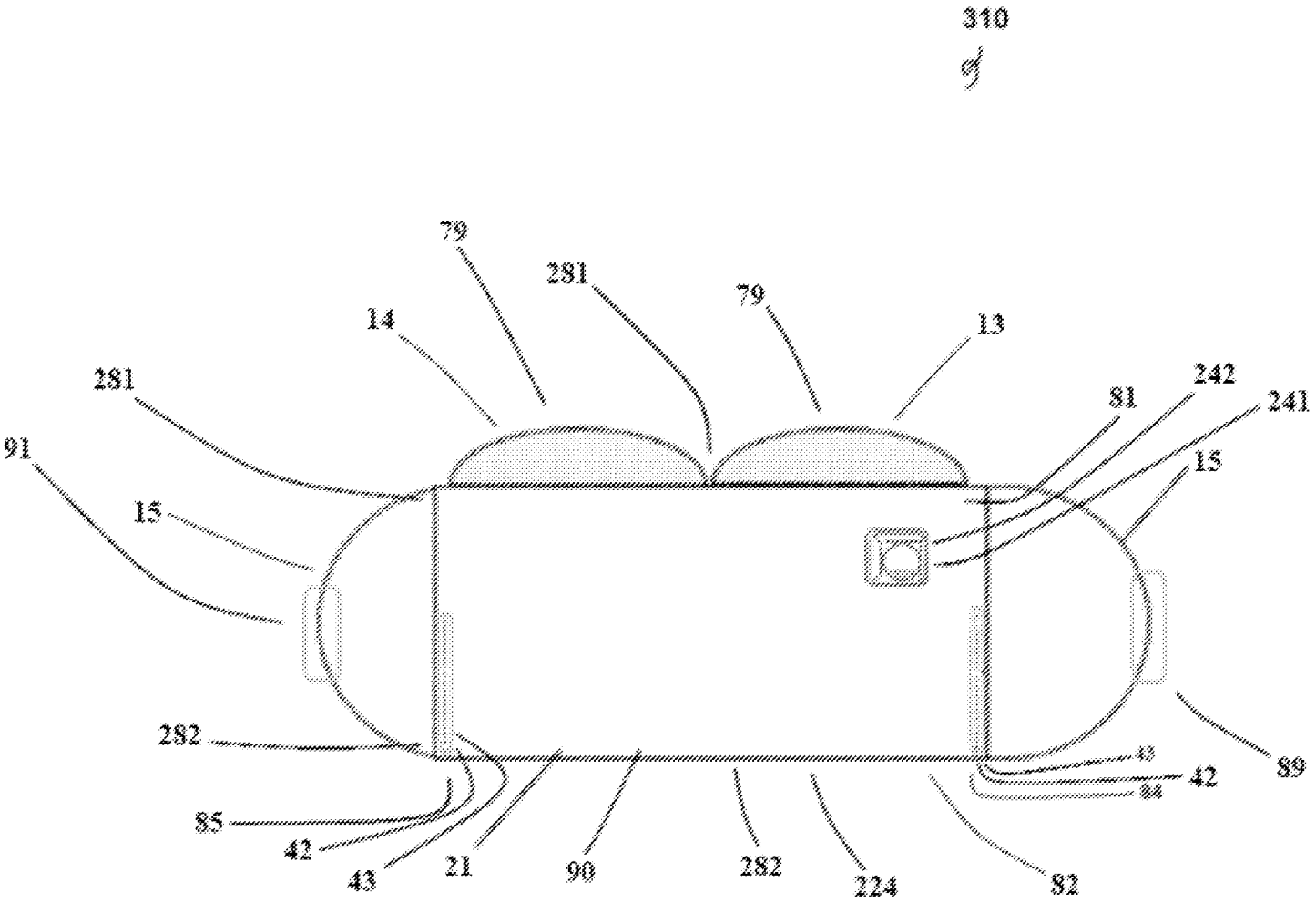
FIG. 10 is an exterior view of the reusable face mask of FIG. 9.
Figure 11:
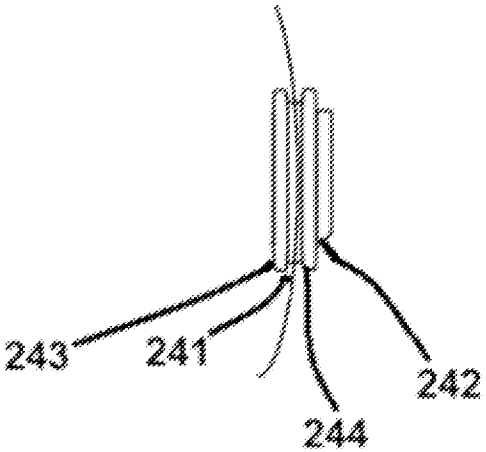
FIG. 11 is a side view of the reusable, woven face mask of FIG. 9, showing the middle layer and the exhalation valve.

Now referring to FIG. 9, FIG. 10, and FIG. 11 the present invention is illustrated as a drawing of a fourth preferred embodiment, showing both an interior surface view 311 and an exterior surface view 21. The embodiment is a reusable face mask which can be formed of multiple fiber layers. The interior layer surface 311 view is drawn in FIG. 9. The exterior layer 21 can be seen in FIG. 10.

For example, the face mask comprises an exterior substrate layer comprising of any standard cloth-based, reusable face mask material such as a tightly woven exterior substrate layer comprising of any standard reusable face mask material such as a cloth or cloth-based material, a tightly woven interior layer comprising of a standard reusable face mask material such as a cloth or cloth-based material, and a middle layer. The reusable face mask can be designed for use by an individual. The interior layer surface makes contact with the skin of the user, and an exterior layer whose surface is visually seen by others. The face mask has a top edge, a bottom edge, a center portion, a left portion, and a right portion. This multi-ply designed face mask can be of substantial size to overlay the entire mouth and at least a portion of the user's nose when the face mask is worn.

The face mask can have two earloops 15 that the user can use to hang the face mask on the user's face.

The face mask can have two wing portions 13, 14 that extend out from the face mask to overlay both of the wearer's zygomatic bones. The wing portions are designed to extend and adhere to each side of the wearers face such that the wearer's nose reside between each of the two winged portions of the embodiment.

The face mask can comprise a skin contact adhesive layer 37 along the top edge of the interior surface of the mask. The skin contact adhesive layer creates an adhesive surface for application on a skin of the user's face and therefore can be configured to be adhered to the skin of the user. The embodiment provides a unique and substantially improved face mask that addresses this problem by substantially preventing air to escape from the top edge of the face mask by adhering the top edge of the face mask to the skin of the user's face, and, as a result substantially prevents the user's eyewear from fogging when the mask is worn.

The skin contact adhesive can be positioned along the top edge of the mask as well as along essentially the interior surface of the two wing portions 13, 14. The skin contact adhesive is not positioned along every edge; it can be very difficult for the user to inhale while wearing the mask if the mask were adhered to the skin of the user from all edges, rendering the mask essentially inoperable. Therefore, it is important that the mask not have a skin contact adhesive along at least one edge, two edges, or three edges of the mask.

The skin contact adhesive on the embodiment can be applied by any standard methods, such as any aforementioned. The skin contact adhesive can be coated throughout the entire interior surface of each of the two winged portions of the embodiment. An important aspect of the present invention is that the skin contact adhesive can be adapted for adhesion onto the skin of the user. As long as this requirement has been met, skin contact adhesives include pressure sensitive adhesives, such as such as an acrylic-based adhesives, rubber-based adhesives such as butyl-based, silicone-based adhesives, porous adhesives, moisture or water-resistant adhesives, hypoallergenic adhesives, and pressure sensitive dermal adhesive designed for removable application.

Cloth-based face masks are often washed and reused. As such, with every wash the skin contact adhesive layer will diminish in strength. Coating the cloth face mask embodiment with a new layer of skin contact adhesive will not function properly if a primer coating is first applied to the cloth material. As such, the embodiment top edge and wings are constructed with a flexible plastic 79 so that the wearer may effectively reapply a skin contact adhesive onto the face mask top edge and wings in a manner such that the face mask can properly function and re-adhere the face mask to the wearer's skin after washing the cloth mask.

To minimize irritation or allergic reactions, the skin contact adhesive, the face mask, or both may be configured to be hypoallergenic and therefore is preferably also sterilized. The skin contact adhesive of the present invention can comprise various types of tensile strengths of adhesives configured to 'stick' to an individual or to an item that is placed on an individual. Having the two wing portions can significantly increase the adhesion of the embodiment onto the face of the wearer.

The embodiment interior surface can also comprise a skin care agent such as a moisturizer. The skin care agent 70 can be applied to the interior surface of the two wing portions using standard methods, and can be done discontinuously or continuously with the skin contact adhesive layer.

The skin care agent can be positioned along the top edge of the embodiment, such as along essentially the entire interior surface of the first wing portion and the second wing portion.

The skin care agent acts as a moisturizer to protect and even improve skin, and comprises of aloes, such as aloe vera, Vitamin E, hydroxyl acids, humectants, ceramides and Zinc. The agent may be separated from, or combined with the skin contact adhesive on said face mask interior surface by any standard methods.

The embodiment also further provides a liner material or a release sheet, which can be configured to cover the skin contact adhesive 37, the skin care agent, or both and keep the skin contact adhesive, the skin care agent, or both, from drying until the user is ready to apply the embodiment to the user's skin. The release sheet can comprise of paper, and may also be made of a flexible sheet of at least one of polyethylene film, polyurethane film and the like, and covers the entire skin contact adhesive to preserve the adhesive layer until the wearer is ready to adhere the mask to the user's skin as the user may wear the mask without activating—or exposing the adhesive layer immediately. If the skin contact adhesives dries before the wearer desires to adhere the face mask onto the wearer's face, then the embodiment may be unable to perform its intended function because adhesives may lose their 'stickiness' and may be unable to properly adhere to the wearer's face when the adhesive dries. The release sheet paper can be peeled off of the embodiment by the wearer exposing the adhesive for application to the wearer's skin. Once the interior surface of the mask is adhered to the wearer's face via the skin contact adhesive layer, subsequent exhaled air from the wearer is prevented from escaping through the mask top edge and, as a result, prevents the wearer's eyewear from fogging up.

The embodiment may also comprise a moisture redirection system 60 or an odor management system to minimize to minimize moisture and bacteria buildup around the mask closest to the user's nose or mouth, or both.

The odor management mechanism can comprise an odor control layer along, or principally along, the left portion and right portion of the mask such as a moisture absorbent layer on the mask, for example.

For example, the aforementioned structure of the embodiment may comprise an exterior substrate layer comprising a tightly woven cloth material, an interior layer comprising of a tightly woven cloth material, and a middle layer.

The middle layer can comprise the odor management mechanism comprising a woven, or non-woven material. The odor management mechanism material can be hydrophilic, and can be configured to hold at least 100% of its weight in moisture such as a cotton or a cloth, such as terry cloth, a cotton absorbent material, which are natural polymers and can hold up to twenty-five times of its weight in moisture and other absorbent polymers such as sodium polyacrylate or other plastic polymers, and other non-toxic materials that are hydrophilic and are configured to hold at least 100% of its weight in moisture such as natural sponges or sponges made from cellulose wood fibers, for example.

The moisture redirection system 60 comprises diagonal channels along an interior layer of the mask 38, 39 which channel moisture away from the user's nose or mouth.

The face mask can comprise an interior surface infused with a skin care agent 93 such as a moisturizer 22, 23 preferable along the interior layer. The skin care agent can be positioned along the face mask left portion 22 and right portion 23 of the face mask interior. The skin care agent acts as a moisturizer to protect and even improve skin, and comprises of aloes, such as aloe vera, Vitamin E, hydroxyl acids, humectants, ceramides and Zinc. The agent may be infused along face mask interior surface by any standard methods. The face mask center portion 83 can be absent of the skin care agent so as not to interfere unnecessarily with the wearer's breathing. As aforementioned, long term use of masks during the school day results in skin dryness around the cheek area where the face mask left portion and right portion touch and reside when a mask is worn. Infusing a skin care agent, such as a moisturizer with a humectant 96, on to the face mask maintains skin moisture around the cheek area when the mask is worn.

The face mask has a top edge 281, a bottom edge 282, a center portion 283, a left portion 284, and a right portion 285, a left side edge 272 and a right side edge 273. This multi-ply designed face mask can be of substantial size to overlay the entire mouth and at least a portion of the user's nose when the face mask is worn. The face mask also provides a standard bendable nosepiece element 249.

The reusable face mask can comprise an elastomer 43 along the left edge and the right edge of the face mask. As aforementioned, the elastomer can be an elastic material 42 such as an elastic material permanently secured along at least most of the face mask left edge and an elastic material permanently secured along most of the face mask right edge. For example, the elastic material can be stitched 41 onto the face mask exterior surface material forming the face mask left edge and right edge. The elastomer can be positioned along the face mask left edge and right edge and can be structured to expand the face mask left edge and right edge when stress is applied to the bottom half of the face mask such as when the wearer's jaw drops when speaking, and immediately return the face mask left edge and right edge back to their original position when the stress has ceased and the wearer closes his or her mouth. The elastic material 42 can be structurally designed to expand and contract as aforementioned and defined. For example, the elastic material can allow the face mask to expand when the wearer opens his or her mouth without essentially moving the face mask top edge, and automatically retract the face mask left edge and right edge to essentially its original position when the wearer stops speaking without the wearer having to manually reposition the face mask with his or her hand.

The elastic material can be secured to the face mask edges while under tension so that when in a relaxed state it folds or crimps the face mask left edge and right edge and positions the face mask left edge and right edge snugly on the wearer's face. The material forming the face mask left edge and right edge can therefore be primarily or entirely flexible and non-rigid so to have the critical flexibility required in a dynamic face mask bottom half. When stress is imposed on the elastic material by the wearer's jaw, the elastic material, now under tension, can expand to allow the face mask bottom half to move with the wearer's jaw to reduce the need to manually having to reposition the face mask.

The elastomer can overlay the lower half of the face mask left edge as well as at least most of the lower half of the right edge. As such, the length should be at least about two centimeters to adequately function as intended. The length maximums will vary. An elastic length of less than 2 centimeters would begin to frustrate the intended function of significantly expanding the face mask left edge and right edge when the wearer speaks. The embodiment has integrally positioned the elastomers to overlay the bottom half of the mask left edge and right edge. In other words, an elastomer can be permanently positioned over approximately about ten percent, twenty percent, thirty percent, forty percent, or fifty percent of the mask left edge and a second elastomer can be permanently positioned over approximately about ten percent, twenty percent, thirty percent, forty percent, or fifty percent of the mask right edge. As aforementioned, the elastomer element comprises a class of elements that stretch when stressed and return to their original state when the stress has ceased.

The face mask left edge 272 and right edge 273 can be constructed of a flexible material that can be folded and unfolded or crimped together and then uncrimped. An elastomer secured to the face mask left edge and right edge would be prevented from expanding and contracting if the material forming the face mask left edge and right edge were of rigid, inflexible material. A rigid face mask left edge and right edge would therefore prevent the present invention for performing its intended function.

The face mask can comprise earloops with anchoring points. The first end of an earloop can be anchored on or near the face mask top left edge 245 while the second end can be anchored on or near the face mask bottom left edge 246. The elastomer can be anchored below the first end of the earloop and above the second end of the earloop of the face mask left edge. A second earloop can be positioned such that the first end of the second earloop is anchored on or near the face mask top right edge 247 and the second end of the second earloop is anchored on or near the bottom right edge 248 of the face mask. The second elastomer is anchored below the second earloop first end and above the second earloop second end of the face mask right edge. Anchoring can be accomplished by any standard methods such as by stitching, ultrasonic bonding or gluing for example. Having flexible, earloops secured at both ends of the face mask are substantially superior than having a strap or straps wrapped around the entire head and only positioned above the wearer's ears; the lack of a strap below the ear and secured on or near the bottom edge as provided by earloops would substantially diminish the face mask bottom half from lowering and subsequently snapping back and rising back to essentially its original position as the wearer's jaw drops and rises when speaking. The earloop and the transverse elastomer may be separate pieces or may be integral with each other provided the earloop is formed of an elastomer as herein defined.

The face mask can comprise protective properties for the wearer's ear in the form of a padded layer or layers on each earloop to prevent injury or irritation. These padded layers can be formed of conventional materials for dissipating pressure across a surface area, can have varying densities and thicknesses, and can be in the form of a layer or multiple layers.

The padded layer 89, 91 on each face mask earloop can be positioned that that it preferably covers at least a portion of the dorsal or back of the wearer's ear where tension from the face mask earloop is the highest. Some embodiments may have the padded layer throughout the contact points between the face mask earloop and the wearer's ears, extending up to as much as about one to three inches along each earloop. The padded layer provided substantially higher shock absorbency and protection than the material forming the earloop. The padded layer can be secured to each earloop by any standard method, such as by stitching. The padded layer can be one uniform cushion, for example, formed of a foam each at least about three millimeters in height, each encased in separate, preferably flexible materials, such as flexible plastics or synthetic cottons.

The face mask can also comprise of an electrostatically charged material 224, such as an electrostatically charged middle layer for example, to further increase the filtration of particles such as bacteria.

The face mask exterior surface layer can have an antimicrobial element 90 as aforementioned.

The reusable face mask may also be coated with UV-absorbers to protect the wearer's skin from harmful sun rays, preferably on the face mask exterior surface. The face mask can be constructed to provide a UPF rating of at least fifteen by coating the face mask exterior layer with non-toxic UV-absorbers such as titanium dioxide or Zinc Oxide, a natural UV-Absorber. The face mask can comprise UV-absorber coatings in the form of plant-basic oils such as Luminora UV protection.

The reusable flexible face mask can have one or more large circular perforations 241 that can create an opening through all layers of the face mask and is of substantial size to house a face mask filter device of fibrous materials or an exhalation valve. Standard filters device of fibrous materials can minimize the pass-through of contaminants such as bacteria and other pathogens.

An exhalation valve 242 may be housed through the face mask perforation. Exhalation valves help exhaled air to leave the mask interior by opening up to release exhaled air when under increased air pressure. An exhalation valve is particularly useful to remove exhaled carbon monoxide thereby making it easier for the wearer to breathe.

The filter device or exhalation valve may be secured by standard methods such as by providing the filter device with two flanges 243, 244 whereby the face mask body circular edge created by the perforation fits snugly between the two flanges on the filtration button or exhalation valve. As aforementioned, the perforation creates an exhalation valve by which the exhale filter device is placed.

The location of the perforation can be positioned as preferred as long as it does not interfere with the expansion and contraction of the face mask left edge and right edge, a critical aspect of the embodiment. FIG. 11 is a side view illustrating the connected valve shown in FIG. 9 and FIG. 10.

Figure 12:
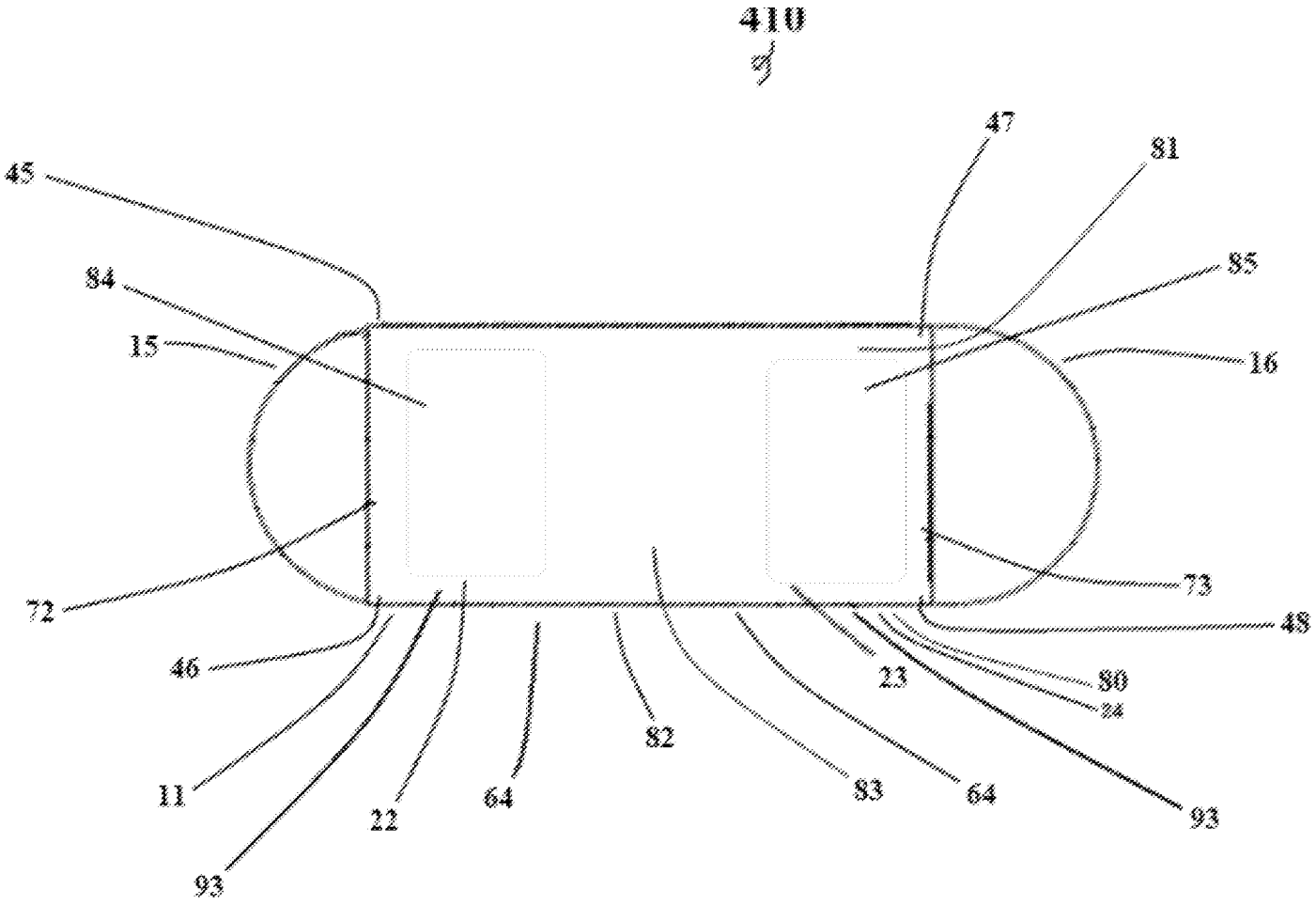
FIG. 12 is illustrates an inner surface of a face mask. The elastomer is in its relaxed state in this view.
Figure 13:
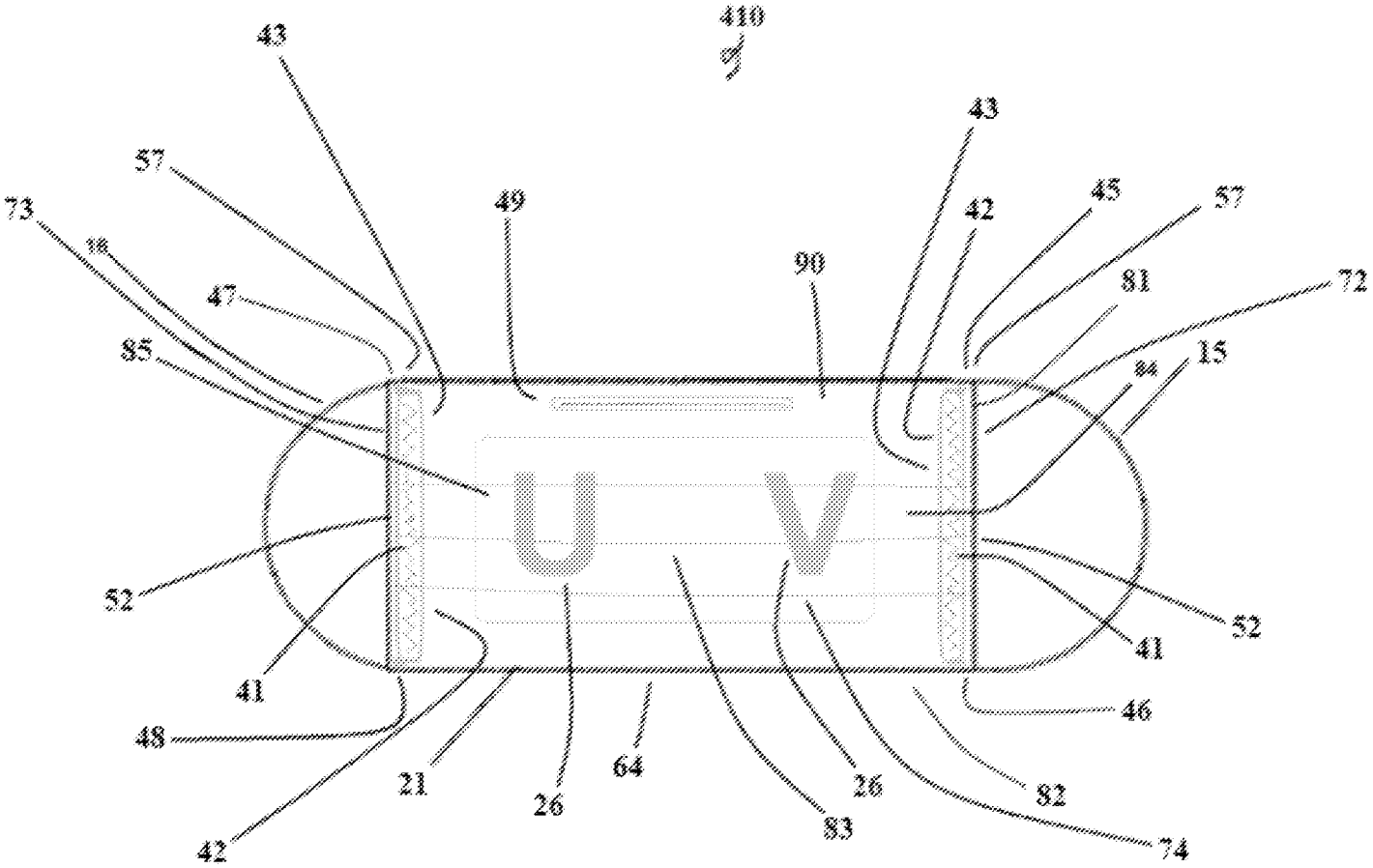
FIG. 13 is an exterior view of the face mask of FIG. 12.
Figure 14:
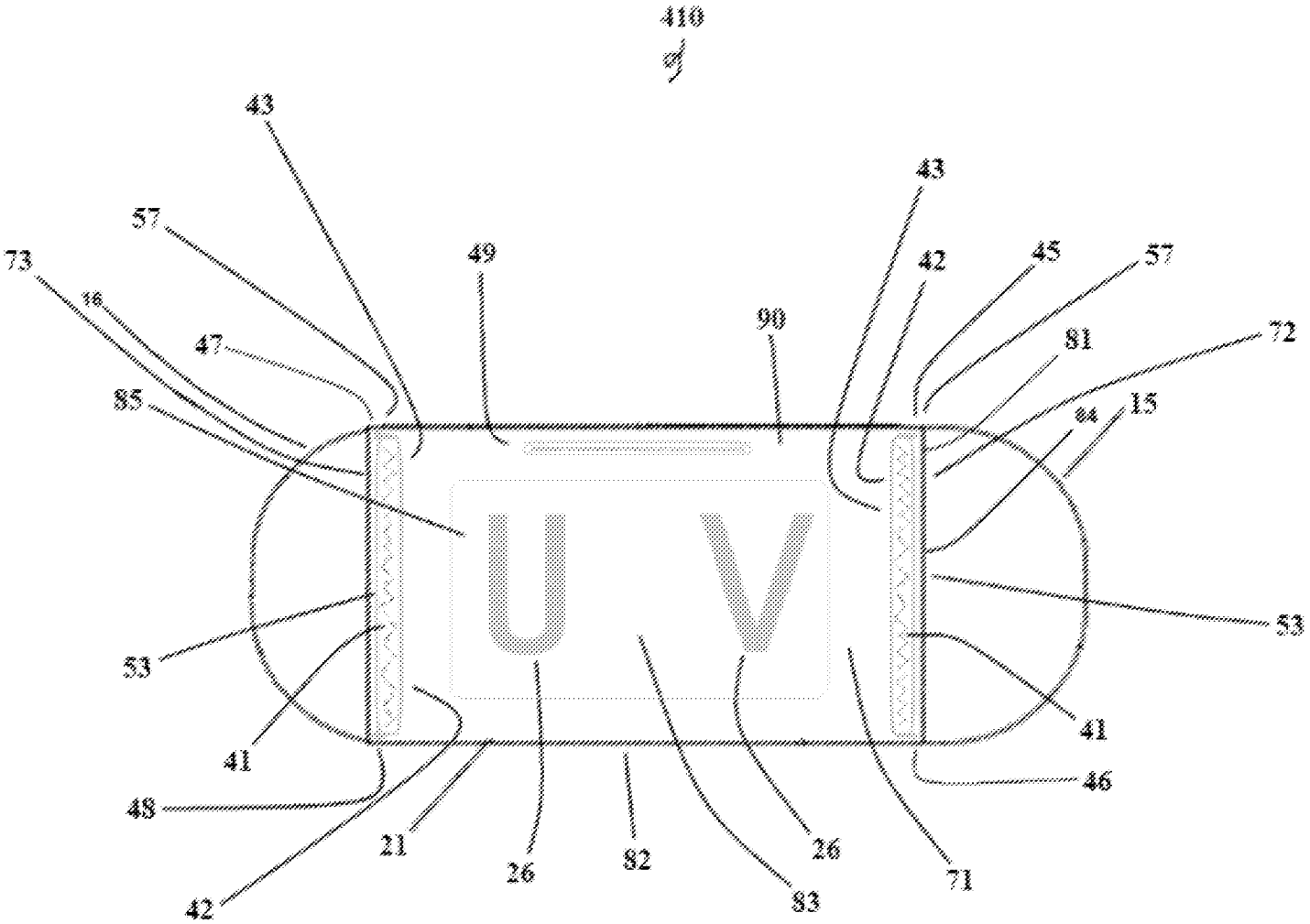
FIG. 14. illustrates a view of the inner surface of FIG. 12 but in an unfolded, expanded state. The elastomer is under tension in this state.

Now referring to FIG. 12, FIG. 13 and FIG. 14, the present invention is illustrated as a drawing of a fifth embodiment 410, showing both an interior surface view 11 and an exterior surface view 21. The embodiment is a face mask which is formed of multiple fiber layers. The interior layer surface 11 view is drawn in FIG. 12. The exterior layer 21 can be seen in FIG. 13. FIG. 14 illustrates a view of the exterior surface of FIG. 12 but in an unfolded, expanded state. The elastomer is under tension in this state.

The face mask can comprise an exterior substrate layer comprising of any standard face mask material described herein. The face mask has a top edge 81, a bottom edge 82, a center portion 83, a left portion 84, and a right portion 85, a left side edge 72 and a right side edge 73. This multi-ply designed face mask is of substantial size to overlay the entire mouth and at least a portion of the user's nose when the face mask is worn. The face mask may be folded 74 preferably three times or so to allow for an expandable center portion for easier breathing when the face mask is worn. The face mask also provides a standard bendable nosepiece element 49. The face mask can have two earloops 15, 16 designed to extend around the wearer's ears.

The face mask can comprise an elastomer 43 along the left edge and the right edge of the face mask. As aforementioned, the elastomer can be an elastic material 42 such as an elastic material permanently affixed along at least most of the face mask left edge and an elastic material permanently affixed along most of the face mask right edge. For example, the elastic material can be stitched 41 onto the face mask exterior surface material forming the left edge, right edge and bottom edge. The elastomer is positioned along the face mask left edge and right edge and is structured to expand the face mask left edge and right edge when stress is applied to the bottom portion of the face mask such as when the wearer's jaw drops when speaking, and immediately return the face mask left edge and right edge back to their original position when the stress has ceased and the wearer closes his or her mouth. The elastic material 42 can be structurally designed to expand and contract as aforementioned and defined. For example, the elastic material can allow the face mask to expand when the wearer opens his or her mouth without essentially moving the face mask top edge, and contract the face mask left edge and right edge to essentially its original position when the wearer stops speaking.

FIG. 14 illustrates a view of the exterior surface of face mask of FIG. 12 in an unfolded, expanded state 71. The significant stretch level of the elastomer 43 allows the face mask left edge 72 and right edge 73 to expand and unfold or uncrimp as the wearer moves his or her jaw in a downward fashion, thus placing the elastomer under tension 53. As the wearer closes his or her mouth the jaw rises. The elastomer under tension will in turn contract as well, folding or crimping and compacting the face mask left edge and right edge, and as such, the elastomer will move toward a more relaxed state 52.

Figure 15:
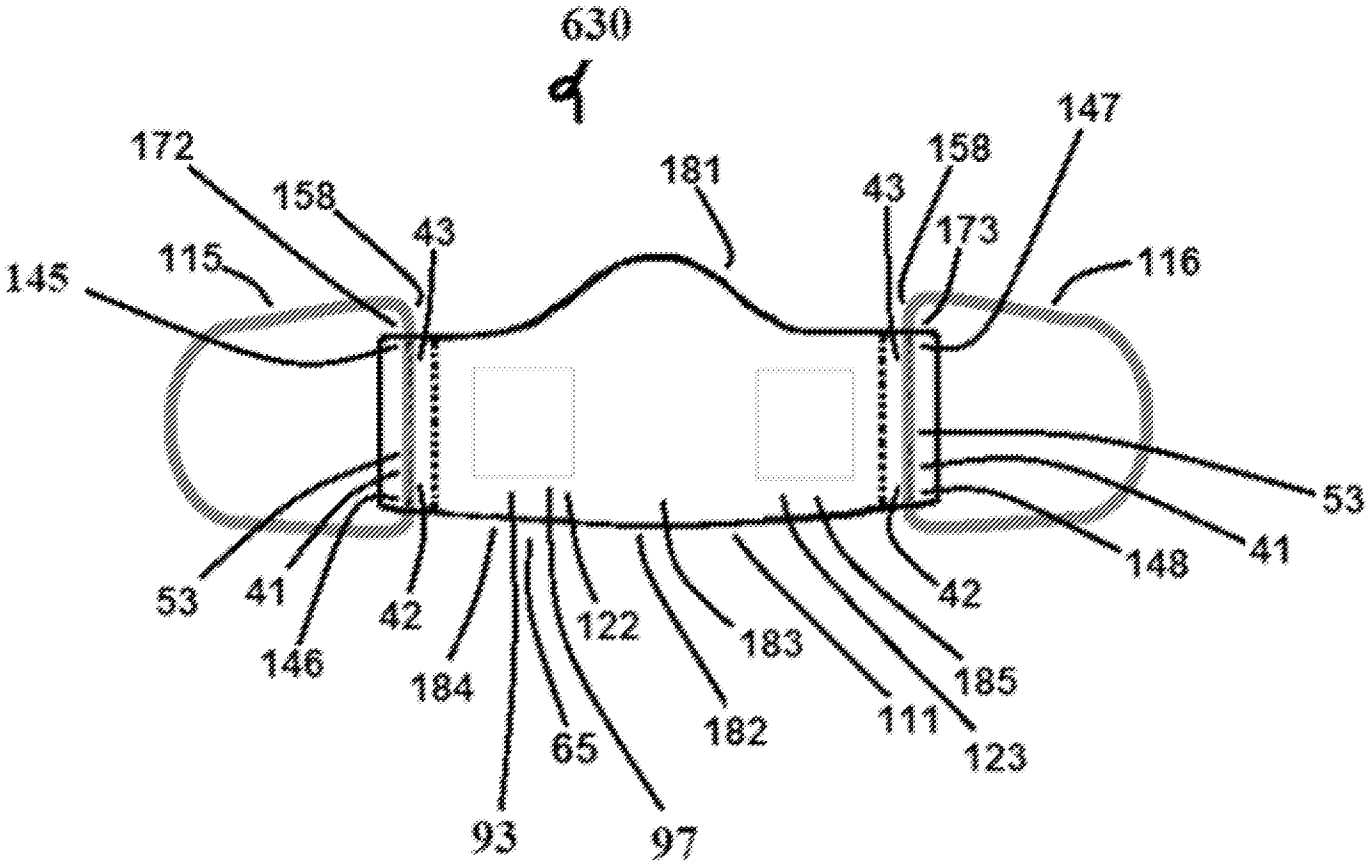
FIG. 15 illustrates an interior view of a cloth face mask.
Figure 16:
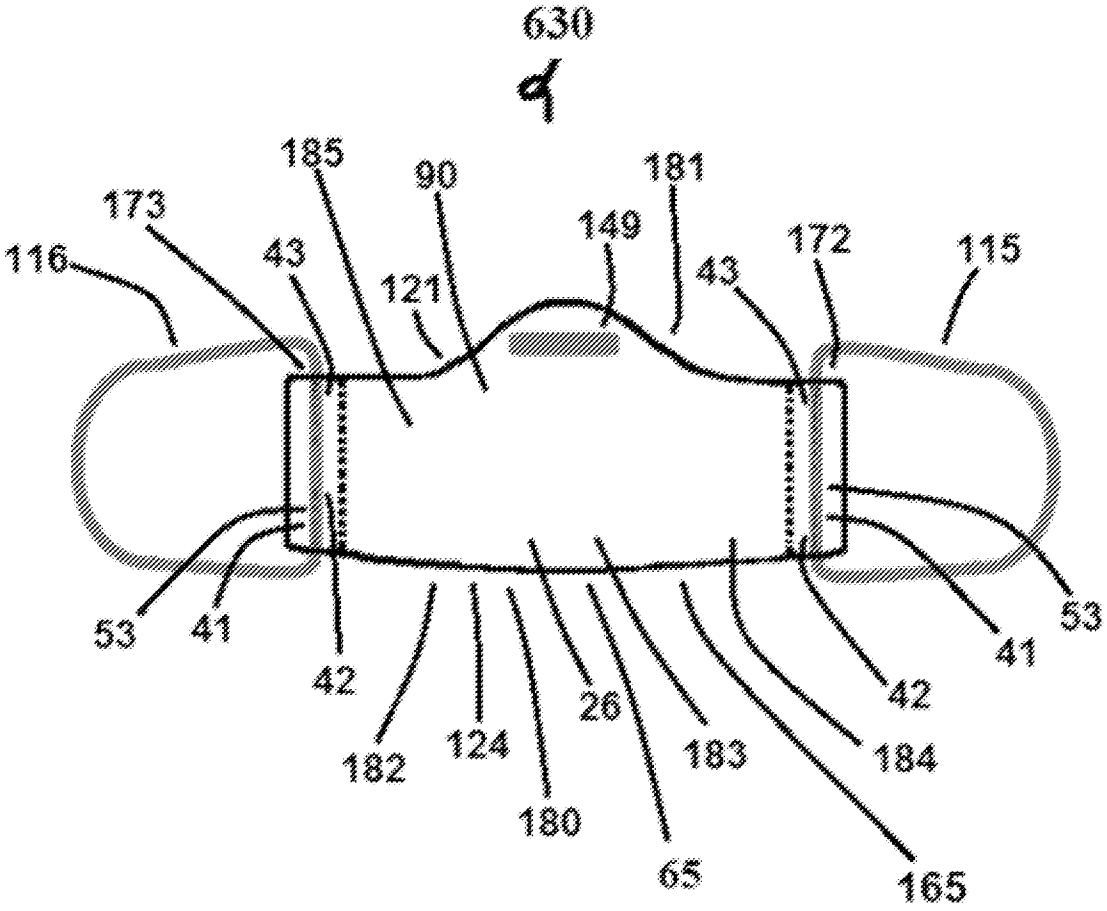
FIG. 16 is an exterior view of the cloth face mask of FIG. 15.
Figure 17:
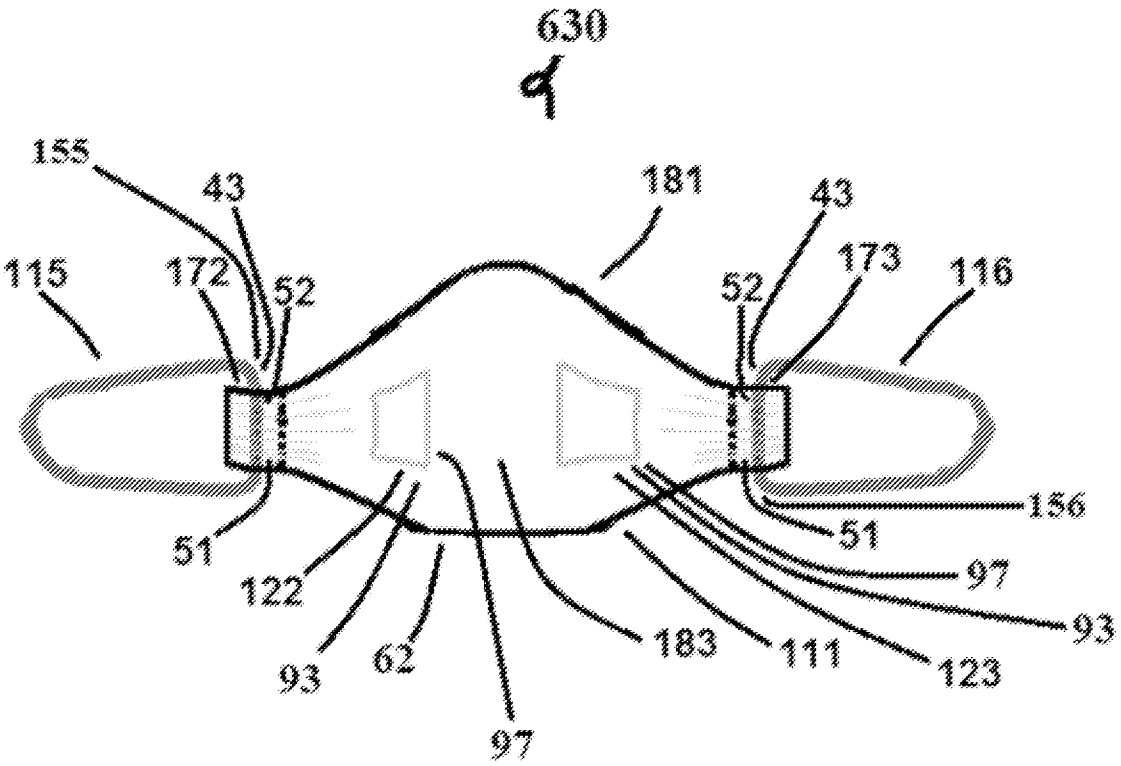
FIG. 17 illustrates an interior view of the cloth face mask of FIG. 15 but in a contracted position.

Now referring to FIG. 15, FIG. 16 and FIG. 17, the present invention is illustrated as a drawing of a sixth embodiment 630, showing both an interior surface view 111 and an exterior surface view 121. The embodiment is a face mask which is formed of multiple fiber layers. The interior layer surface 111 view is drawn in FIG. 15. The exterior layer 121 can be seen in FIG. 16. FIG. 17 is an illustration of the interior view of the cloth face mask of FIG. 15 but in a contracted, compacted position.

FIG. 17 shows another view of the interior surface 111 of the sixth embodiment, however this view shows the elastic materials secured to the face mask edges in a relaxed state 52 and thus fold or crimp 51 the face mask left edge and right edge material and positions the face mask left edge and right edge snugly on the wearer's face. As aforementioned, the material forming the face mask left edge and right edge can therefore be primarily or entirely flexible, non-rigid so to have the critical elasticity required in a dynamic face mask bottom half. The elastic materials, when under tension, can move the face mask bottom half downward to mimic the movement of the mouth without essentially moving the face mask top edge and thus minimizing the need to reposition the face mask when talking. As the wearer stops talking, his or her jaw moves upward in a closed mouth position, and the bottom half of the face mask automatically retracts to its initial face mask position by the elastomers on the left edge and the right edge with the elastomers positioned back to its relaxed state 52.

Figure 18:
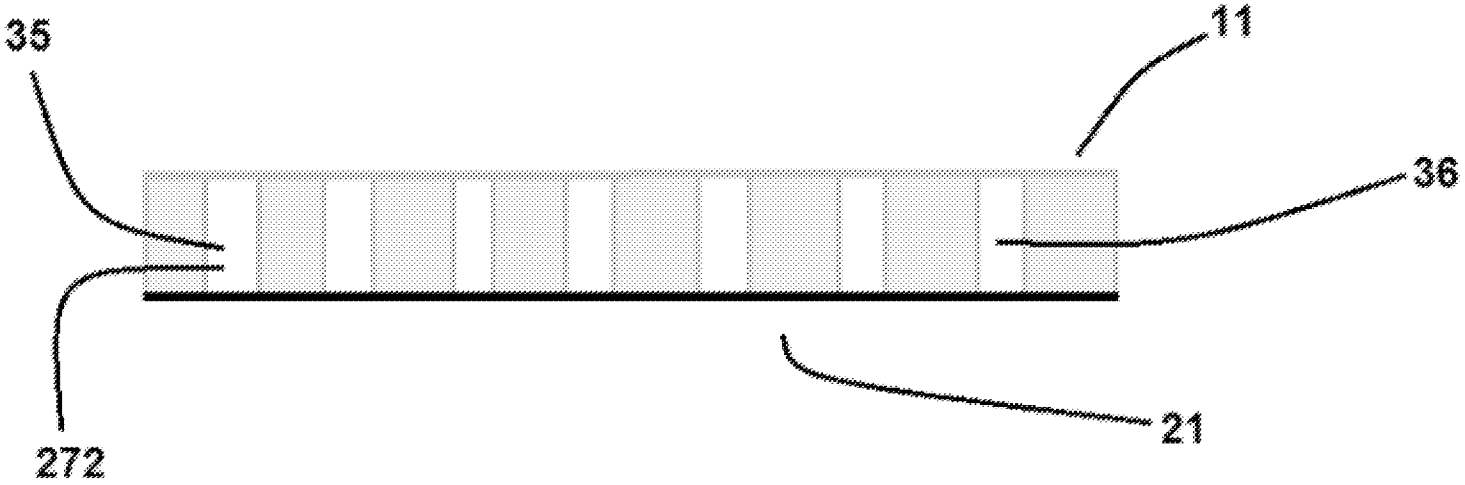
FIG. 18 is a side view of a middle layer showing the channels that dissipate moisture.

FIG. 18 is a side view drawing of the moisture redistribution system as a plurality of elongated depressions 35, 36 which create airways so that exhaled air or moisture may dissipate from the middle portion of the face mask around the mouth and nose of the wearer. As shown, the depressions are of substantial depth 272 whereby exhaled air can flow through them. These channels are hydrophobic or layered with a hydrophobic coating so to prevent moisture buildup along the channels. The middle layer is also preferably electrostatically charged to substantially increase the face mask ability to inhibit bacteria and microbial penetration. For example, the face mask middle layer can be an electrostatically charged non-glass polypropylene microfiber non-woven material by standard methods, or tightly woven materials.

Figure 19:
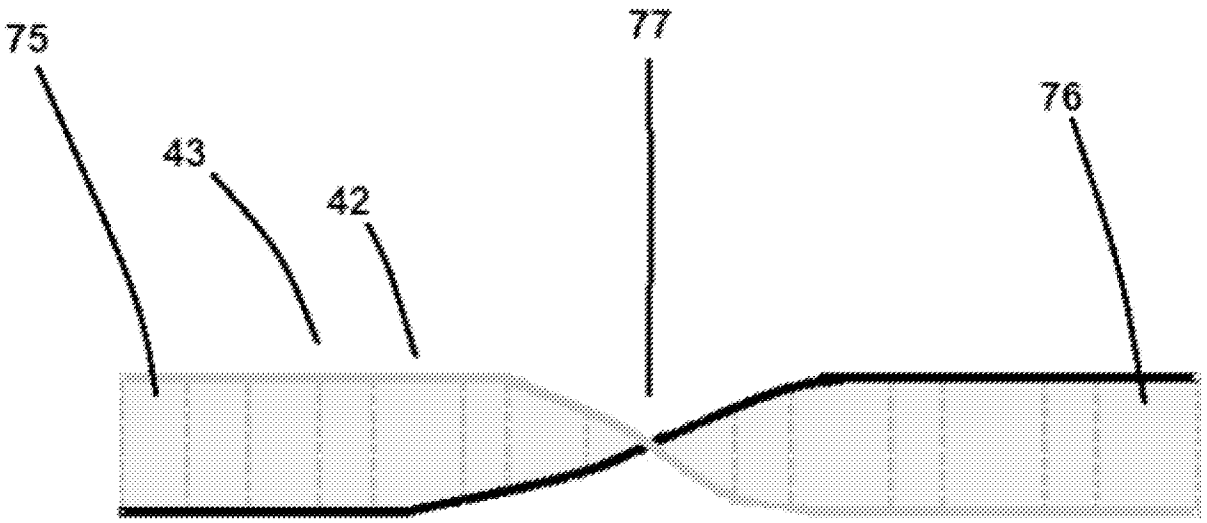
FIG. 19 is an illustration of an elastomer, twisted and thereby showing its top surface as well as its bottom surface.

FIG. 19 is a side view illustration of an elastomer 43 formed of an elastic material 42. The elastic material 42 is in a twisted position 77, showing the top surface 75 and bottom surface 76. The elastomers are a class of elements that stretch immensely when stressed and immediately return to their original state when the stress has ceased. Elastomers can have a stretch factor of ten or more. Elastomers constructed of a rubber elasticity are known to have a factor of ten, for example. Elastomers with lower stretch factors of five are also able to provide acceptable stretch-ability but construction would begin to pay close attention to snapback velocity and snugness requirements.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A face covering for filtering air comprising an inner layer, wherein the inner layer comprises a skin care agent;

an outer layer; and a middle layer, wherein the middle layer comprises a hydrophilic material, wherein the middle layer further comprises a plurality of hydrophobic elongated depressions.

2. The face covering of claim 1, wherein the inner layer comprises an adhesive.

3. The face covering of claim 2, wherein the adhesive comprises an acrylate.

4. The face covering of claim 2, wherein the adhesive discontinuously covers 25% of a length of a top edge of the face covering.

5. The face covering of claim 1, wherein the skin care agent comprises one or more of a humectant, a moisturizer, or an anti-inflammatory.

6. The face covering of claim 5, wherein the humectant comprises one or more of aloe vera, tretinoin, hydroxyl acid, Vitamin A, zinc, hyaluronic acid, glycerin, or ceramide.

7. The face covering of claim 1, wherein the middle layer or the inner layer comprises an anti-microbial agent.

8. The face covering of any one of the above claims, wherein the middle layer comprises an electrostatically charged material.

9. The face covering of claim 1, wherein the middle layer is removable.

10. The face covering of claim 1, wherein the outer layer comprises a polypropylene based material.

11. The face covering of claim 1, further comprising a sterile liner that is removed prior to application.

12. The face covering of claim 1, further comprising an expandable element.

13. The face covering of claim 12, wherein the expandable element extends from a top portion of the face covering to a bottom portion of the face covering.

14. The face covering of claim 1, wherein the hydrophilic material is configured to hold at least 100% of its weight in moisture.

15. The face covering of claim 1, wherein the hydrophilic material does not extend laterally to reach side edges of the mask and does not extend vertically to reach a top edge of the mask.

16. The face covering of claim 1, wherein the hydrophilic material is of sufficient size to overlay a user's mouth and does not extend beyond the user's mouth.

17. The face covering of claim 1, wherein the hydrophilic material comprises one or more of a cotton material or a sponge material.

18. The face covering of claim 1, wherein a center portion of the face covering positioned over a user's mouth opening does not comprise the skin care agent.

19. The face covering of claim 1, further comprising two earloops, wherein the earloops have padding.

* * * * *